US010724539B2

(12) United States Patent
Hub et al.

(10) Patent No.: US 10,724,539 B2
(45) Date of Patent: Jul. 28, 2020

(54) DIAGONAL OR RADIAL FAN HAVING A GUIDE DEVICE

(71) Applicant: Ziehl-Abegg SE, Künzelsau (DE)

(72) Inventors: Sandra Hub, Pfedelbach (DE); Frieder Loercher, Braunsbach (DE); Andreas Gross, Kirchensall (DE); Lothar Ernemann, Heilbronn (DE)

(73) Assignee: Ziehl-Abegg SE, Kunzelsau (DE)

( * ) Notice: Subject to any disclaimer, the term of this patent is extended or adjusted under 35 U.S.C. 154(b) by 212 days.

(21) Appl. No.: 15/570,335

(22) PCT Filed: Apr. 25, 2016

(86) PCT No.: PCT/DE2016/200193
§ 371 (c)(1),
(2) Date: Oct. 28, 2017

(87) PCT Pub. No.: WO2016/173594
PCT Pub. Date: Nov. 3, 2016

(65) Prior Publication Data

US 2018/0142700 A1 May 24, 2018

(30) Foreign Application Priority Data

Apr. 28, 2015 (DE) ..... 10 2015 207 800

(51) Int. Cl.
*F04D 29/44* (2006.01)
*F04D 29/28* (2006.01)
*F04D 25/06* (2006.01)

(52) U.S. Cl.
CPC ..... *F04D 29/444* (2013.01); *F04D 29/282* (2013.01); *F04D 25/0606* (2013.01); *F05D 2230/51* (2013.01); *F05D 2230/53* (2013.01); *F05D 2250/52* (2013.01)

(58) Field of Classification Search
CPC ..... F04D 29/444; F04D 29/44; F04D 29/441; F04D 29/281; F04D 29/624
See application file for complete search history.

(56) References Cited

U.S. PATENT DOCUMENTS

| | | | | |
|---|---|---|---|---|
| 6,224,335 | B1 | 5/2001 | Parisi et al. | |
| 10,072,557 | B2 * | 9/2018 | Gullberg | F04D 17/16 |
| 2006/0280596 | A1 * | 12/2006 | Kim | A47L 5/22 415/119 |

FOREIGN PATENT DOCUMENTS

| | | | |
|---|---|---|---|
| CN | 200963828 | Y | 10/2007 |
| DE | 3712567 | A1 | 10/1987 |
| DE | 202008002356 | U1 | 6/2009 |

(Continued)

*Primary Examiner* — Richard A Edgar
(74) *Attorney, Agent, or Firm* — McDonnell Boehnen Hulbert & Berghoff LLP

(57) ABSTRACT

A diagonal or radial fan comprises a rotating motor fan wheel and an upright guide device that in terms of flow is connected downstream of the motor fan wheel, wherein the motor fan wheel comprises a motor and an impeller with blades that is rotary driven by the motor, said blades being arranged between an impeller cover plate and an impeller base disk, wherein the guide device comprises at least one guide device cover plate and one guide device base disk, and wherein the guide device cover plate and the guide device base disk are in continuous elongation to the impeller cover plate and the impeller base disk.

18 Claims, 16 Drawing Sheets

(56) References Cited

FOREIGN PATENT DOCUMENTS

Figure 1A:
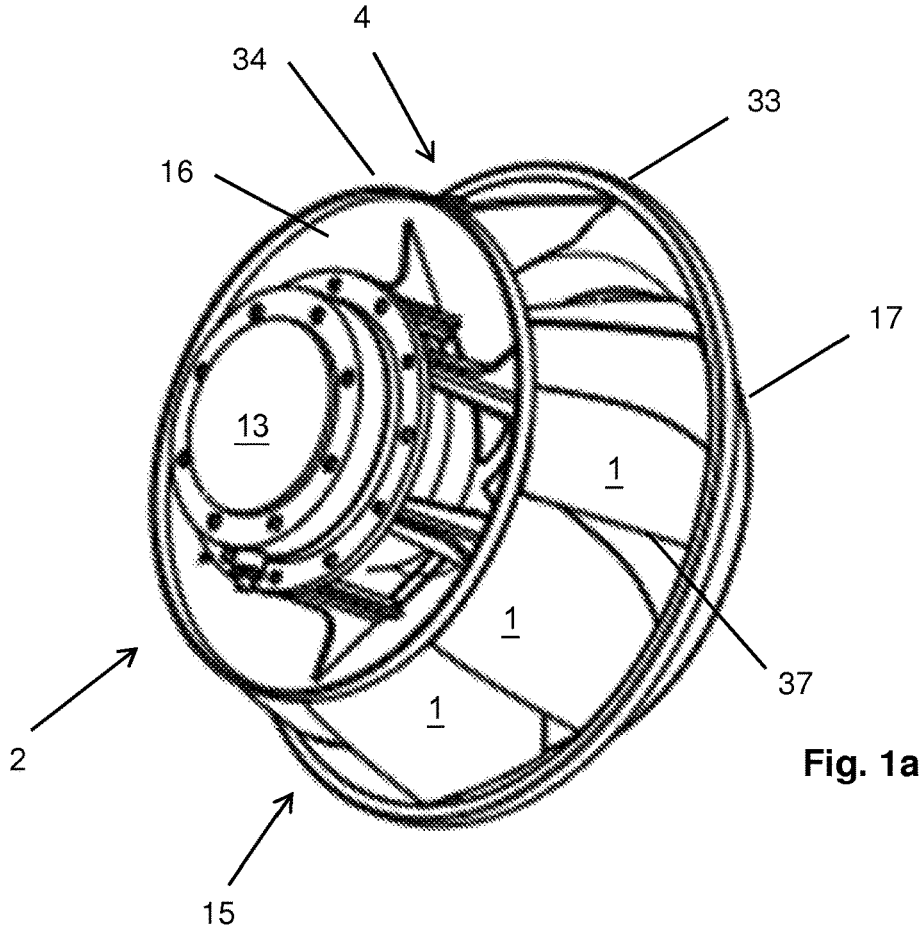

| | | | |
|---|---|---|---|
| EP | 2410183 | A2 | 1/2012 |
| EP | 2792885 | A1 | 10/2014 |
| WO | WO-2015005832 | A1 * | 1/2015 |

* cited by examiner

DIAGONAL OR RADIAL FAN HAVING A GUIDE DEVICE

This application is a U.S. National Phase Application pursuant to 35 U.S.C. § 371 of International Application No. PCT/DE2016/200193 filed Apr. 25, 2016, which claims priority to German Application Serial No. 10 2015 207 800.0, filed Apr. 28, 2015. The entire disclosure contents of these applications are herewith incorporated by reference into the present application.

The invention relates to a diagonal or radial fan. Free-running diagonal or radial fans, in particular such with backward curved blades, are well known from practice. In the case of such fans there are no flow-conducting parts arranged downstream from the impeller outlet such as for example spiral housing, outlet guide vanes, diffusers or the like. The flow exiting the impeller has high flow speeds. The dynamic pressures accompanying these flow speeds are not used in the case of free-running diagonal or radial fans. This means loss of pressure and energy, hence such fans have too low pressure increases, too low air-flow rates and too low efficiency. Moreover, these high flow speeds cause noise emissions that are too high on the outlet. In addition, frequently braces are used for connecting the motor fan wheel to the nozzle plate, which are regularly very close to the impeller outlet. As a result, they constitute an impediment in the flow path and have an additional negative effect on the air-flow rate, the efficiency and the acoustics. Free-running diagonal or radial fans are however frequently compact, that means they have low, often rectangular shaped space requirements in a higher-level system, and can be manufactured cost-effectively.

A radial fan is known in and of itself from EP 2 792 885 A1 that has a round, bladed guide wheel on the air outlet side for improved air circulation. This guide wheel simultaneously serves the purpose of a suspension, but does not assist in the improvement of efficiency. The guide wheel comprises a cover plate and a base disk, each when in mounted state continuing the corresponding cover plate or base disk of the impeller, as well as guide blades, which are partially arranged between the cover plate and base disk of the guide wheel, however, which extend beyond their outer edges seen in the direction of throughflow. Another disadvantage in the case of the know radial fan is the fact that, seen in the direction of throughflow, the guide device cover plate and the guide device base disk diverge greatly from one another, i.e. the flow cross-section widens significantly in the direction of throughflow. This leads to turbulence in the region of the guide device, increases the noise level there and simultaneously reduces the air-flow rate and hence the efficiency.

The present invention therefore addresses the problem of embodying and developing the generic diagonal or radial fan such that the problems occurring in the prior art are at least largely eliminated. The same applies for the guide device and the higher-level system with such a diagonal or radial fan.

This problem is solved in inventive manner by a fan with the features of claim 1, in which namely the guide device cover plate and the guide device base disk are approximately in continuous elongation to the impeller cover plate and the impeller base disk. The air-flow rate, efficiency and acoustics are significantly improved by the inventive guide device. The inventive fan is designed to be space saving and can be produced inexpensively.

The present disclosure solves the problem with respect to the guide device and with respect to the system.

In order to improve the air-flow rate and/or the efficiency and/or the acoustics, an operational guide device is arranged downstream from the impeller of an inventive diagonal or radial fan. The advantages of free-running fans such as for example the low space requirements as well as low production costs are, at least to the greatest possible extent, retained. Such a diagonal or radial fan comprises at least a rotating motor fan wheel, a nozzle plate and an upright guide device that in terms of flow is connected downstream of the motor fan wheel. The motor fan wheel comprises a motor and an impeller having blades that is rotary driven by the motor, wherein the blades are arranged between an impeller cover plate and an impeller base disk. The guide device comprises at least one guide device cover plate and one guide device base disk as well as in the case of advantageous embodiments guide blades, that are firmly connected between guide device cover plate and guide device base disk. The necessary connection of the motor to the nozzle plate can be completely undertaken by the guide device, or further connection elements are provided on the fans.

In accordance with the invention it has been observed that in the case of the provision of a guide device one can use the cover plate and the base disk there to extend the cover plate and base disk of the impeller such that a kind of continuous elongation of the cover plate and base disk of the impeller takes place on its downstream edges. The high flow speeds on the impeller outlet are at least partly reduced in the guide device, namely in particular due to the diffuser action of the guide device cover plate and guide device base disk. In the case of advantageous embodiments with even higher efficiencies, the fixed guide blades provide for an additional reduction of flow speeds for the benefit of efficiency and static pressure increase. The course of the impeller cover plate and impeller base disk, viewed in section with a plane through the axis of rotation, is approximately continued by the course of the guide device cover plate and the guide device base disk, likewise viewed in section with a plane through the axis of rotation. The described course of the cover plate and base disks, viewed in section, substantially determines the direction of throughflow, at which the circumferential component of the flow speed is not considered.

Taking the inventive teaching as a basis, dynamic pressure which is contained in the flow speed of the flow exiting the impeller, can be at least partially converted into static pressure. This means that the air-flow rate as well as the system efficiency of the fan increase in the case of comparable or lower noise emissions. Moreover, it is possible that the sturdy designed guide device, if guide blades are present, can assume supporting functions, as a result of which the ordinarily provided fastening braces can be omitted.

The guide device connected downstream in terms of flow is used to delay flow speeds. Flow speed elements in the direction of throughflow (flow-through speeds) as well as flow speed elements in circumferential direction (rotation flow speeds) can be delayed and the respective contained dynamic pressures can be completely or partially converted to static pressure. In this respect this module can be referred to as a diffuser and outlet guide unit. A diffuser unit, which as a rule involves lateral walls for the flow through, such as the cover plate and base disk of the guide device, delays in particular the flow-through speed. An outlet guide unit, which as a rule involves guide blades, delays in particular rotation flow speeds. As a result, the air-flow rate and the efficiency of the fan in the case of comparable or lower noise emissions increase considerably. Studies have shown that by using the inventive guide device predefined operating points are achieved with up to 5% lower speed than in the case of conventional implementations, without such a guide device. In the process, the static efficiency is increased by up to 15%.

The guide blades of an advantageous embodiment of the guide device can be configured differently. It is conceivable that the guide blades are identical in design. In the process, it is possible to arrange the guide blades uniformly distributed or symmetrically along the circumference or to arrange them unevenly distributed or asymmetrically. The cross-section of the guide blades is advantageously designed similar to an airfoil profile. Such embodiments have especially high air-flow rate, efficiency and especially low noise emissions. In the case of other embodiments, in which the guide device has a supporting function, the guide blades can also have simpler cross-section designs, for example the design of a circle, an ellipse, a rectangular profile or a thin wall (of a sheet metal) with constant wall thickness.

In a further variant the guide blades of the guide device can differ from one another in design, for example in shape, size and arrangement. In particular the blades can differ in their chord length, i.e. in their length along the flow path. In the process the guide blades can be arranged unevenly distributed or asymmetrically along the circumference or be arranged uniformly distributed or symmetrically. Preferably the points of intersection of all guide blade front edges are with a plane perpendicular to the axis of rotation of the impeller approximately on the same diameter or deviate by a maximum of ±5% from a common mean diameter.

It is essential that the guide device has a guide device cover plate and a guide device base disk, wherein the guide device cover plate and base disk each continue the corresponding cover plate or base disk of the impeller. Advantageously guide blades are configured in the region between the guide device cover plate and base disk, which in turn can in cross-section have the shape of an airfoil profile or be unprofiled, for example in sheet metal design with constant or varying wall thickness or in the design of connection braces in plastic.

In the case of the unprofiled or profiled guide blades in cross-section, positive acoustic effects can be achieved by a corrugated blade front edge (tubercle) or a corrugated blade surface.

In the case of especially advantageous embodiments an inventive radial or diagonal fan has low space requirements and is compact. This permits the installation of such fans in higher-level systems with little available space. Typically a rectangular shaped region is provided as available space for a fan in a higher-level system, tailored to existing free-running radial or diagonal fans according to the prior art, or in order to arrange several fans laterally next to and on top of one another for the purpose of parallel operation. Advantageously, inventive fans find space in an existing, preferably rectangular shaped available space of an existing higher-level system. To be able to use such available space advantageously, advantageous embodiments also have preferably rectangular shaped space requirements or make optimum use of a preferably rectangular shaped space in compact manner. In the case of further advantageous embodiments an inventive guide device is configured such that it can be mounted on an existing fan with spinning suspension and of preferably rectangular shaped space requirements without having to make great changes to it. This also makes it possible to add an inventive guide device to a fan already in operation.

Since compactness, low space requirements and/or retrofitability on an existing fan in accordance with prior implementations in the case of inventive radial or diagonal fans is strongly associated with a preferably rectangular shaped outer form, it is advantageous if the downstream edges of the guide device cover plate and base disk of the guide device in the projection onto a plane perpendicular to the impeller axis of rotation are preferably rectangular in design. The inner contour of the guide device base disk and/or guide device cover plate describing the flow channel of the guide device can be a solid of rotation, a geometry arising from a solid of rotation through a recess or a notch on the edge or a geometry deviating from it that is not formed from a solid of rotation (freeform surface).

In further advantageous manner, the guide device cover plate and the guide device base disk run parallel to one another, at least in cases where the impeller cover plate and the impeller base disk are arranged parallel to one another. In advantageous manner the angles between the cover plates or base disks at the transition between the impeller and the guide device are a maximum 15°, advantageously less than 15°, further advantageously about 0°, which means, tangent continuity between the cover plate and base disk of the impeller and the guide device. However, in order to achieve compact design, it can be advantageous to deviate significantly from the ideal case in terms of flow of tangent continuity.

At the transition of the cover plates and the base disks a gap of the smallest possible size occurs, namely between the rotating impeller and the stationary guide device. The leakage air flow passing through the gap leads to a reduction of the volumetric air flow and of the efficiency. This gap should be as small as possible, preferably smaller than 2% of the external diameter of the fan device. If required measures can be implemented for reduction of the leakage air flow on the gap, for example a so-called labyrinth seal. Lateral overlapping of the cover plate or base disk of the guide device with the cover plate or base disk of the impeller are likewise conceivable.

In principle it is also conceivable to provide an unbladed guide device, which namely comprises solely a base disk and a cover plate preferably parallel to it. The flow path can also be elongated or enlarged in this way in the direction of throughflow after the impeller outlet, as a result of which the flow speed is reduced and converted to usable static pressure. Positive effects can be achieved on the air-flow rate of the fan.

The guide device can be made of plastic, of metal or a combination of the two materials, in particular also of a composite material. If the guide device is a plastic injection molded part, it can be produced in one piece or can be assembled from multiple parts from advantageously, to a large extent, identical segments. The segments can be connected to one another by screwing, riveting, bonding, welding, snap hooking etc. . . . . Assembly of the guide device from several different or identical segments is especially suitable in the case of large external impeller diameters, for example from an external impeller diameter of 400 mm. This has in particular the advantage that the size and complexity of the injection molding tool can be radically reduced.

It is also conceivable that function elements are integrated in the guide device or molded on, for example braces or retaining elements for connecting the guide device to the motor for connection to a nozzle plate. Additional mounting devices for direct connection of the guide device to other fan parts can likewise be integrated in the guide device or molded on. In the case of design of the guide device in multiple parts, centering and mounting aids can be provided at the joints, for example pins, cones, straps, snap hooks, tongue and groove joints. These aids in particular serve the purpose of simplification of the mounting, in the case of design in multiple parts serving the purpose of more precise positioning of the individual segments of the guide device relative to one another as well as the more precise positioning of the guide device relative to other components such as for example the impeller, the engine mounting or other fans. Moreover, at the joints of the segments there is the possibility of mounting additional function elements without significantly increasing the mounting expenditure, for example fastening elements made of sheet metal or plastic parts for connection to the nozzle plate or to the motor. Any desired function elements can be mounted to the segment separations or integrated in them.

In further advantageous manner the guide device has a supporting function, i.e. it transfers the forces and torques, which are necessary for holding the motor fan wheel relative to the nozzle plate during operation, idle state, storage or transportation, completely or at least to a large extent. This supporting function, which in the past was realized by fastening braces, can be completely taken over by the guide device. To this end the previous fastening braces in the region of the impeller outlet are replaced by the bladed guide device. A connection between the cover plate of the guide device and a nozzle plate as well as between the base disk of the guide device and the motor can for example be realized by sheet metal or plastic braces.

In the case of a supporting function as well as a non-supporting function of the guide device, braces made for example of plastic or sheet metal or so-called support plates can be used to connect the guide device to the motor, which in the case of design in multiple parts of the guide device are preferably integrated or connected in the region of the joints of the segments. The connection elements between the guide device and the nozzle plate or between the guide device and the motor can be integrated in a single piece in the guide device, namely in plastic injection molding, in particular in the case of small dimensions. As an alternative the connection elements can be manufactured as separate plastic/sheet metal parts, in particular in the case of large dimensions and be screwed, bonded, welded, riveted, strapped or the like to the guide device.

The fastening braces are in advantageous manner especially sturdy and torsion-resistant in design, in order to ensure a high inherent stiffness and hence low deformation and low oscillations in using the guide device as a supporting element of the fan. In addition, it is conceivable that additional apparatuses are provided on the external diameter of the guide device, for example apparatuses for fastening a contact protection means. For example, this can be straps, screw eyes, core holes for self-tapping screws for plastic applications, inserts or the like.

In one especially advantageous embodiment the guide device with non-supporting function can be combined with an already existing suspension of a fan according to the prior art, for example with a so-called spinning suspension. Among other things, this makes it possible to retrofit devices in use with an inventive guide device. To this end the guide device is connected to the spinning suspension by screw, clip-on, plug or welded connections. Corresponding provisions can be made on the cover plate and/or base disk of the guide device and/or on the suspension. It is particularly advantageous if provisions are carried out in the form that the guide device can be fastened directly on the existing suspension.

In the case of a further advantageous embodiment the guide device or the guide device cover plate is fastened to a plane support plate directly on the motor. In addition, it can be advantageous, not to design the base disk and/or cover plate of the guide device as a solid of rotation or trimmed solid of rotation due to the available space, in particular also due to an existing suspension. To prevent collisions between the guide device base disk with an existing suspension and simultaneously to maintain an approximately tangential continuation of the impeller base disk, the guide device base disk can be designed in wavy/curved shape. This means that a section of the guide device base disk with a cylinder surface that lies coaxial to the axis of rotation does not have the geometry of a circle or a circular segment, but rather has a variance or a waviness in a direction parallel to the axis of rotation. Four wavelengths along the circumference of the guide device cover plate or base disk are particularly advantageous. As a result, the thus far very compact design height of the motor fan wheel is completely or nearly retained by the addition of the guide device and the previous suspension can continue to be used without or without significant changes.

In the case of a further particularly advantageous embodiment of a radial fan with supporting guide device, which can be produced and mounted especially easily and inexpensively and which is economical in particular for small dimensions, the guide device is constructed essentially in 2 parts. The motor connection and the nozzle plate connection are already integrated in this 2-part guide device. Both parts are plastic injection molded parts, wherein the required injection molding tools are comparatively simple. One of the parts essentially consists of the base disk of the guide device and a connection of the guide device to the motor. The other part essentially consists of the cover plate of the guide device, the guide blades and a connection of the guide device to the nozzle plate. The guide blades run parallel to the axial direction. The connection elements of the guide device to the nozzle plate are configured in the form of an elongation of the guide blades in axial direction beyond the cover plate. As a result the assembly of the guide device together with the nozzle plate can be carried out quickly and easily with 4 screws, which are inserted through a through hole completely from the nozzle plate up to the base disk of the guide device or the motor connection of the guide device. The injection molding tools for the two parts of the guide device as well as also the nozzle plate can be designed comparatively simply, since there are no undercuts whatsoever in axial direction, i.e. in the demolding direction of the tools. Centering and fixing aids can be provided on the nozzle plate as well as the motor connection.

One or more inventive fans can be used in higher-level systems such as precision air-conditioning units, heat pumps, air handling units or compact air handling units, electronic cooling modules, generator ventilation systems, or industrial/residential cooling units. In such systems there is often a limited, frequently preferably rectangular shaped available space for the fan or fans arranged next to or on top of one another.

The impeller is a diagonal or radial impeller according to the preceding statements.

There are different possibilities for embodying and developing the teaching of the present invention advantageously. To this end, reference is made on the one hand to the subordinate claims to claim 1 and on the other hand to the following explanation of preferred exemplary embodiments of the invention on the basis of the drawings. In conjunction with the explanation of the preferred exemplary embodiments of the invention on the basis of the drawings, generally preferred embodiments and developments of the teaching will also be explained. The figures show the following.

The figures show the following

Figure 1B:
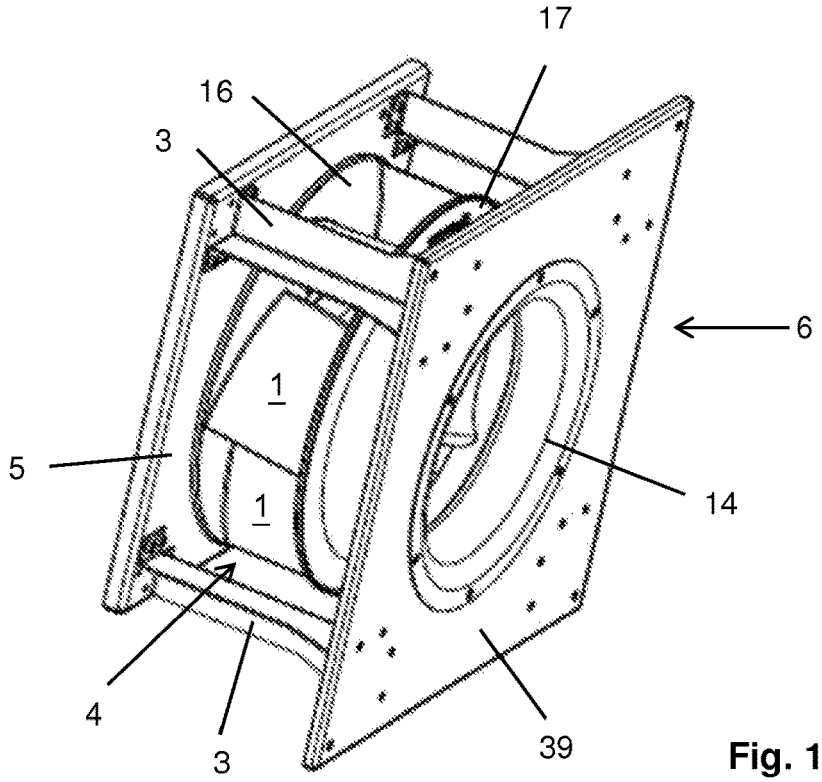
Figure 1C:
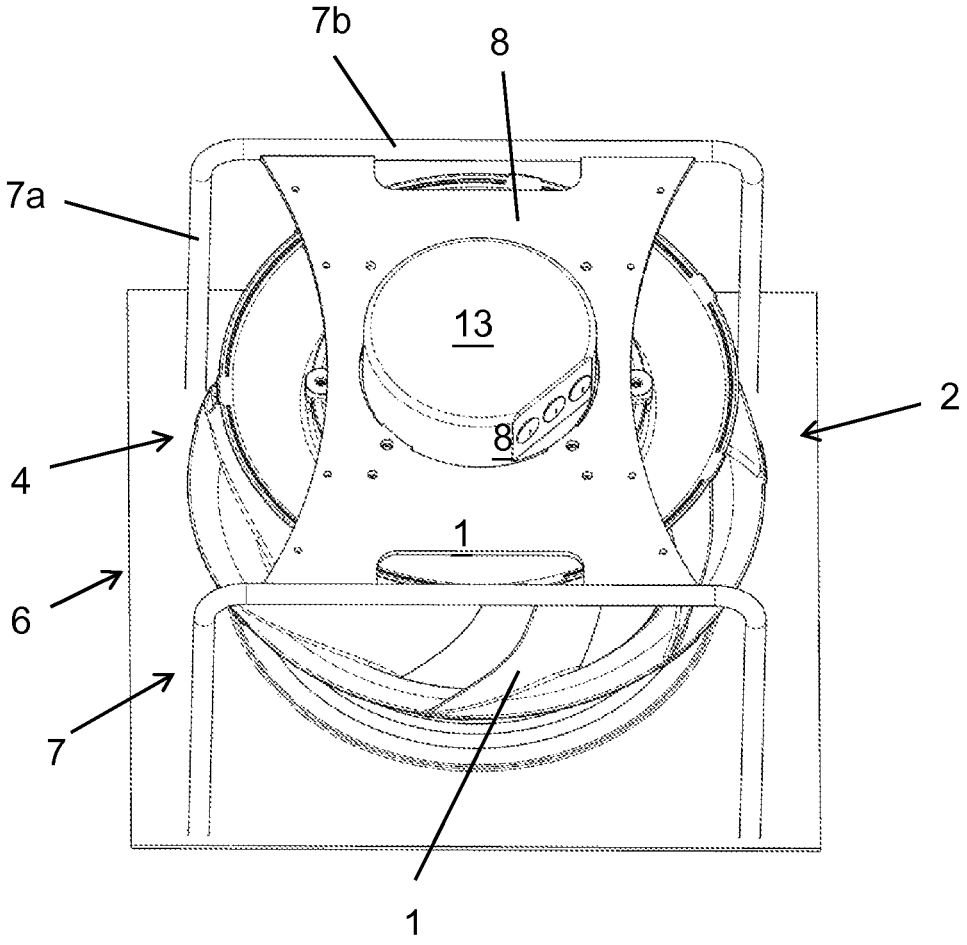
Figure 2A:
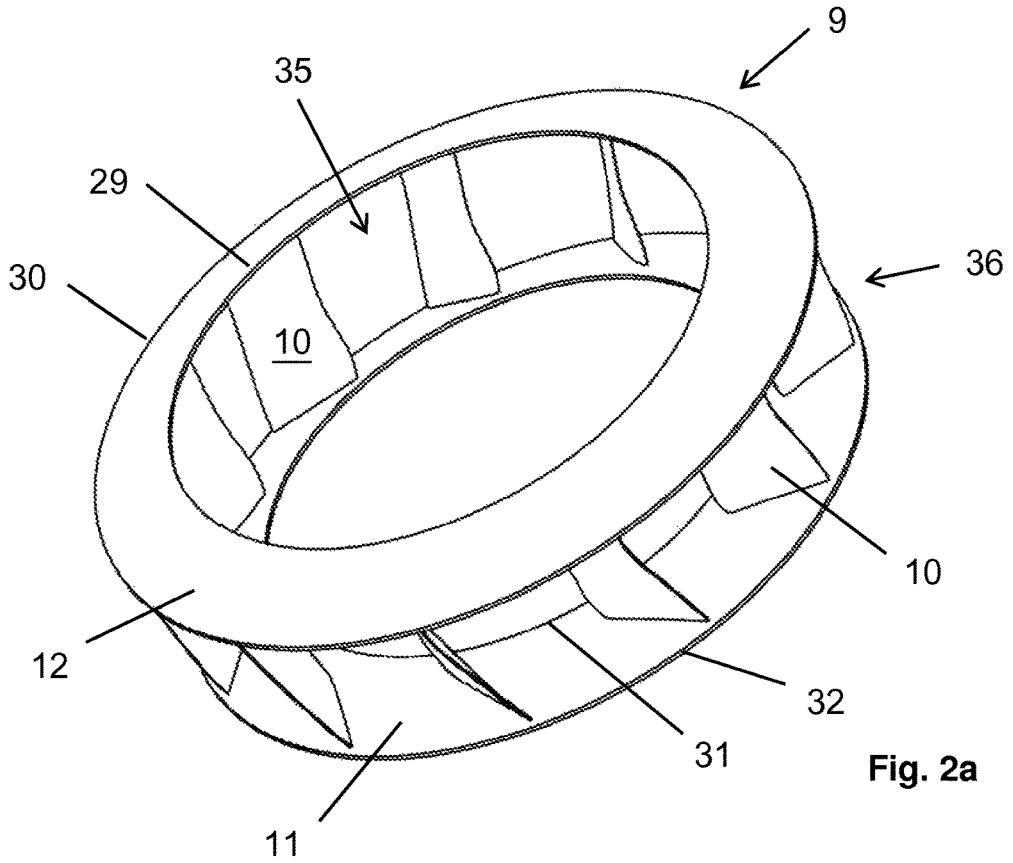
Figure 2B:
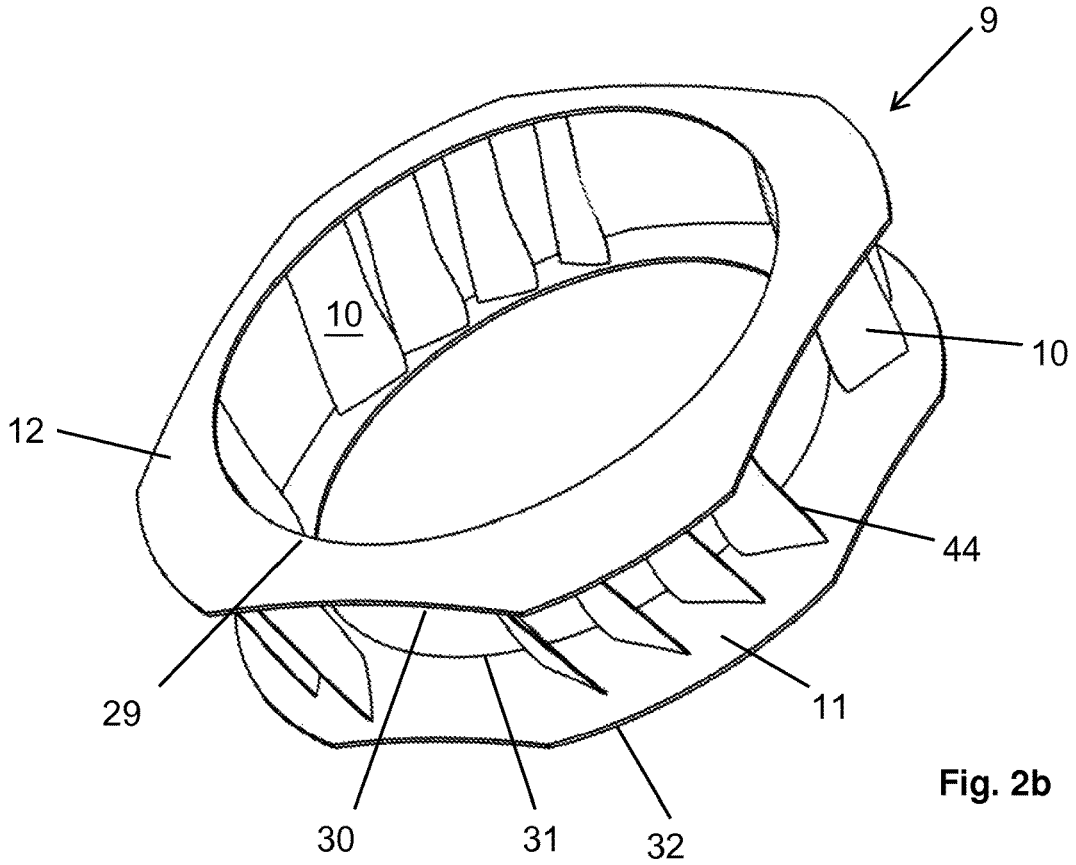
Figure 3A:
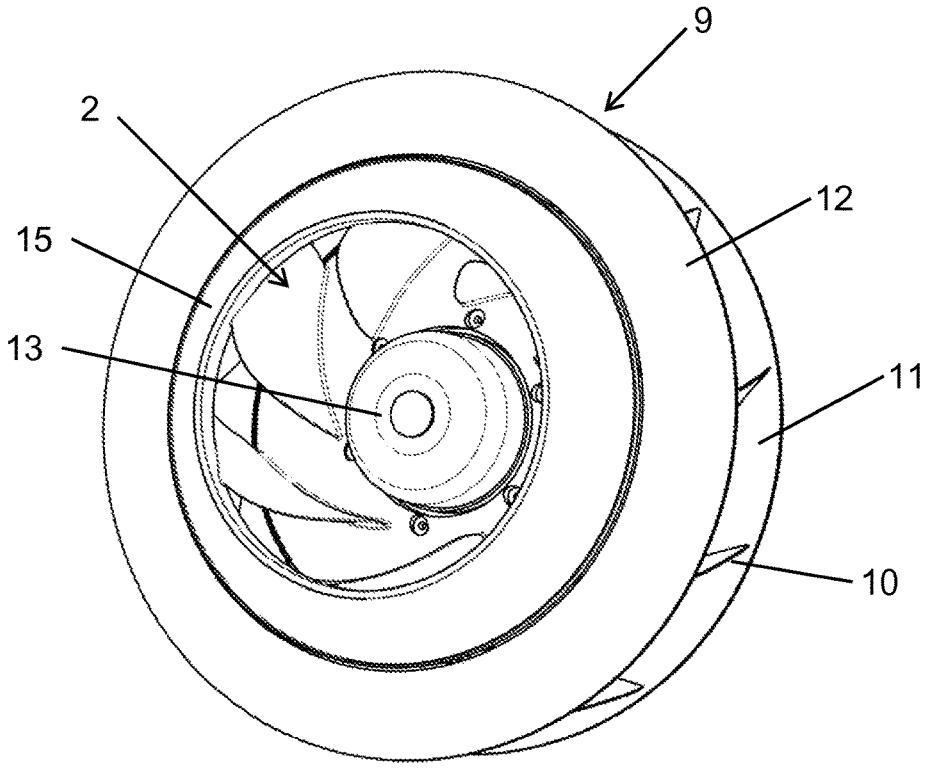
Figure 3B:
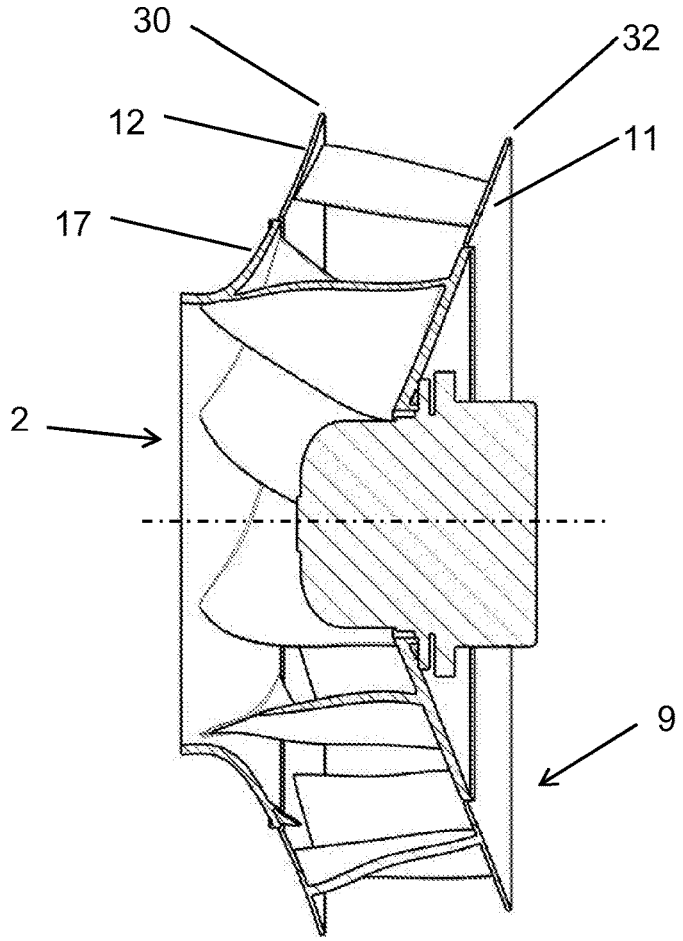
Figure 4:
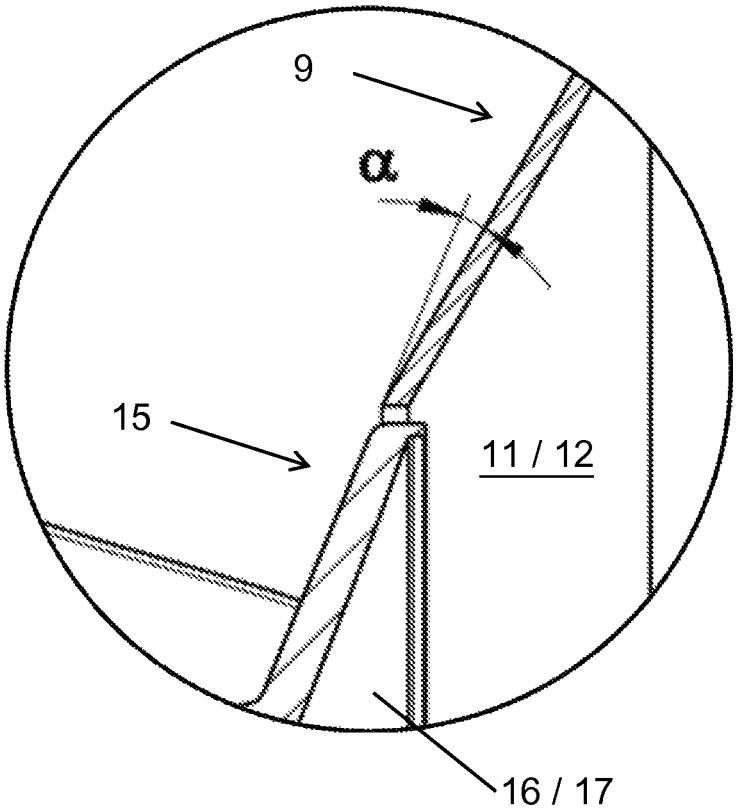
Figure 5A:
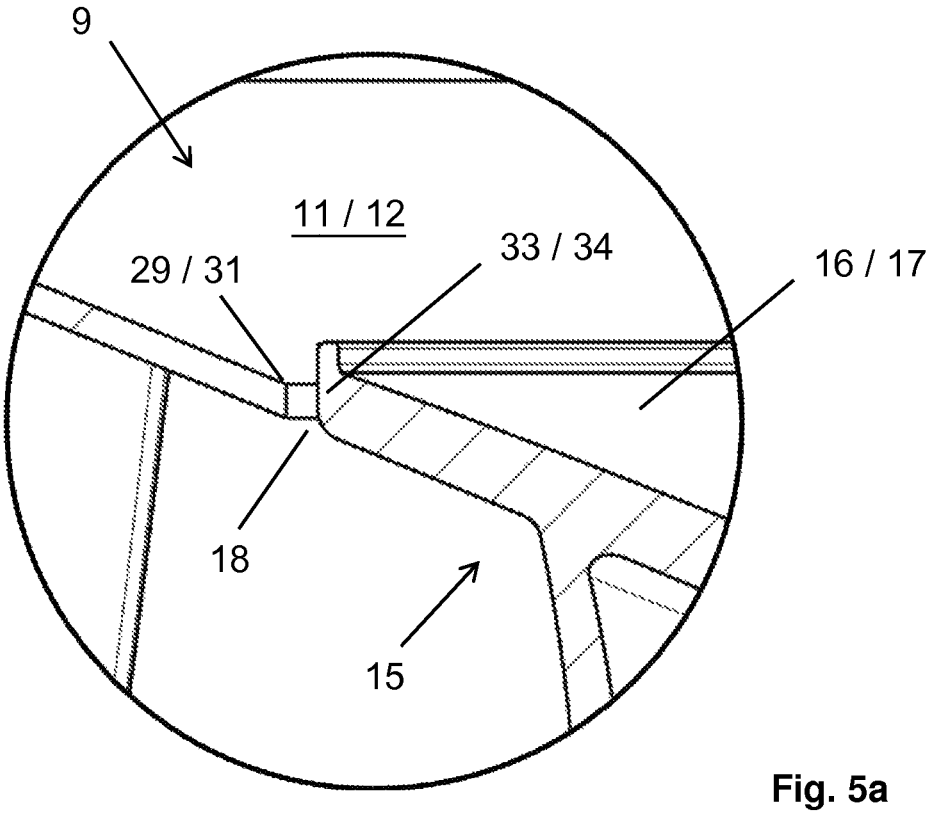
Figure 5B:
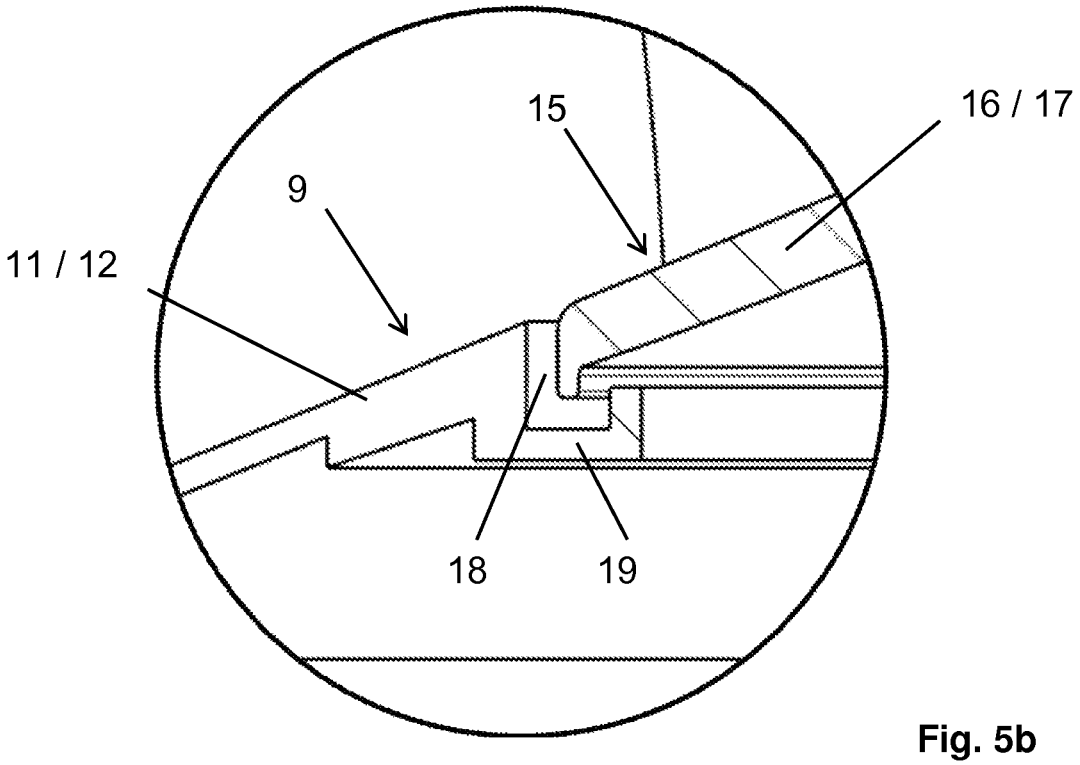
Figure 6A:
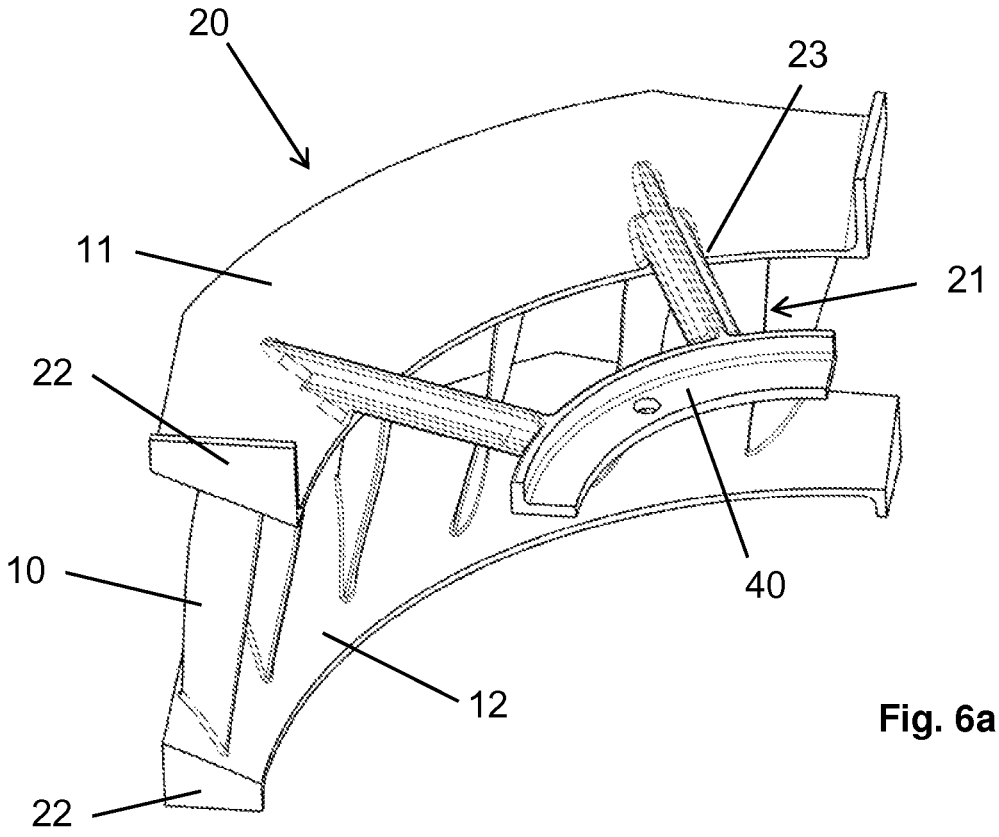
Figure 6B:
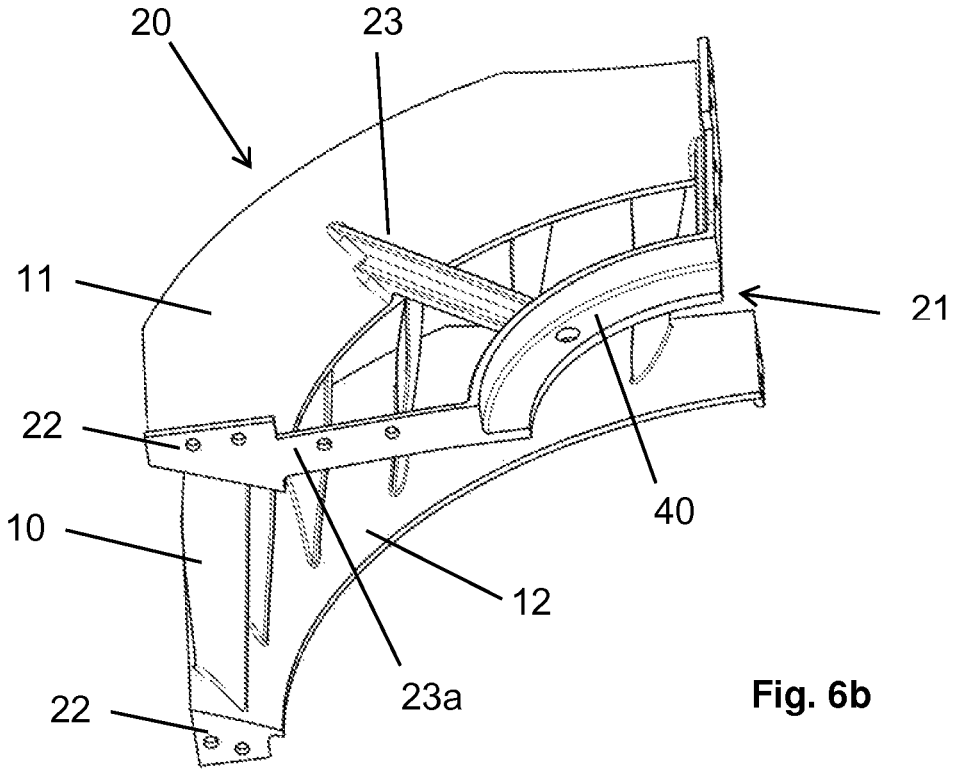
Figure 6C:
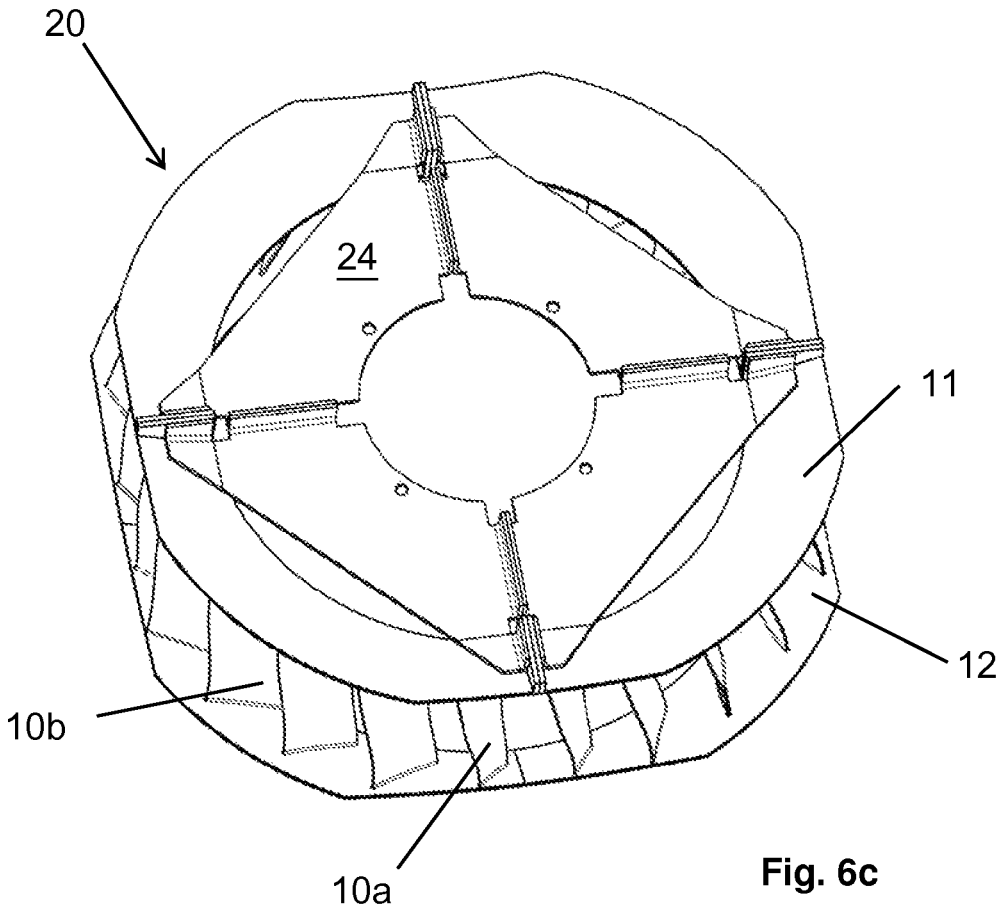
Figure 7:
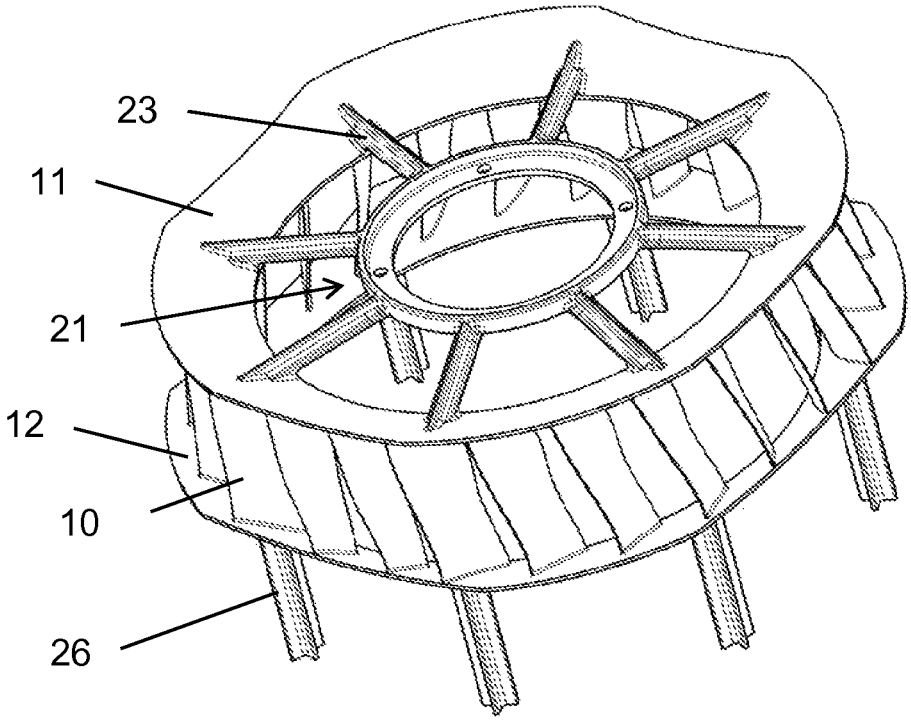
Figure 8A:
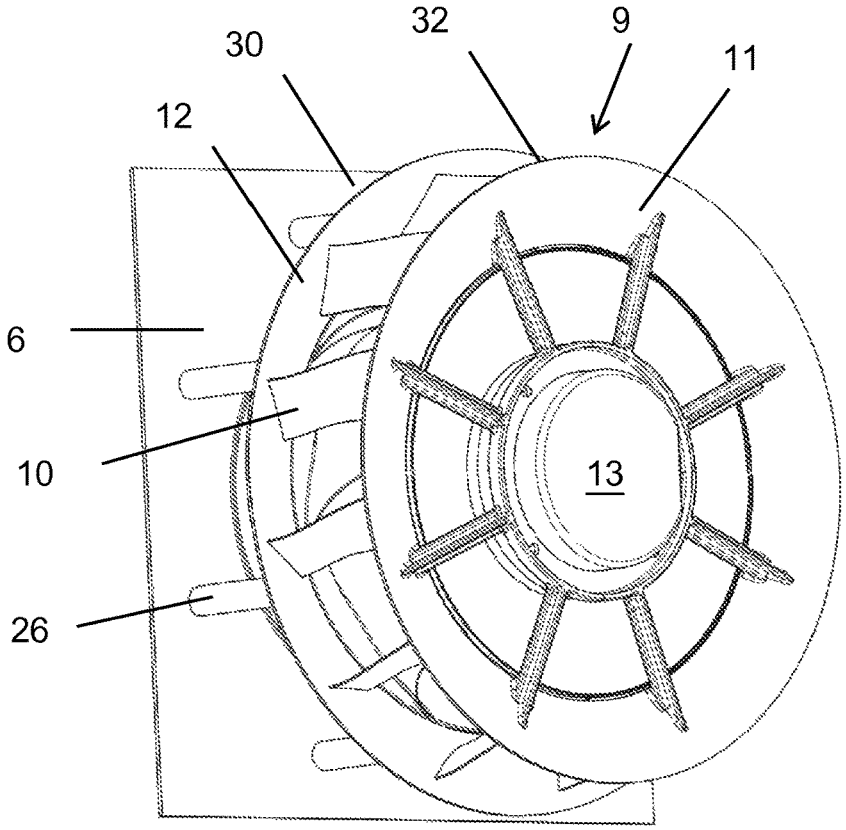
Figure 8B:
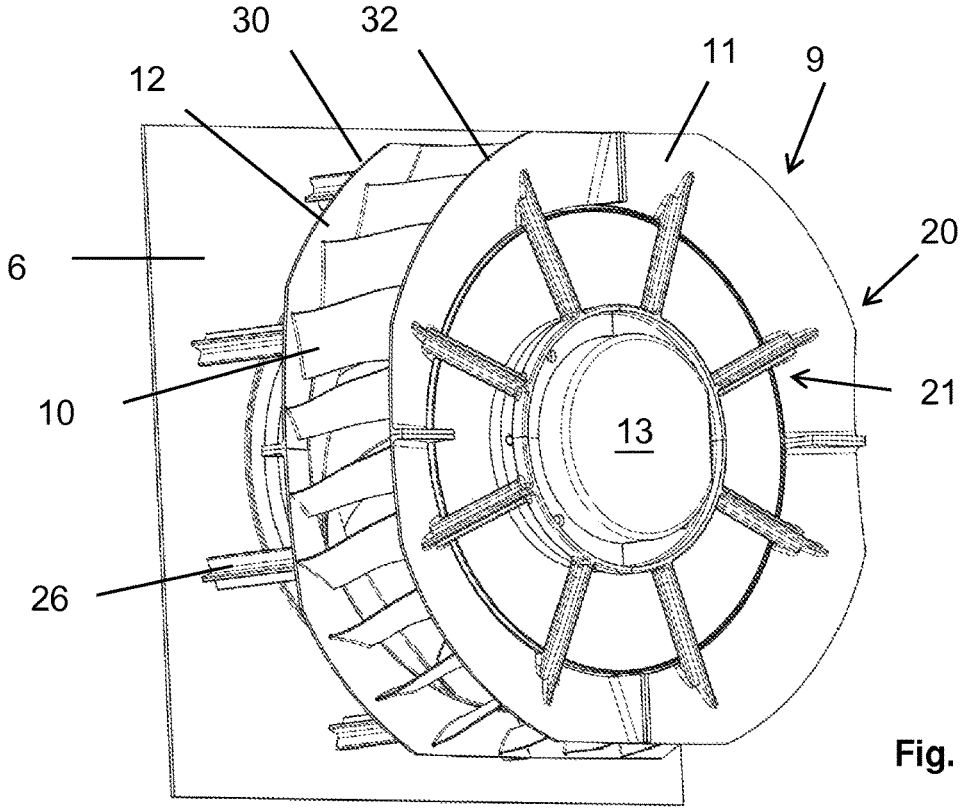
Figure 8C:
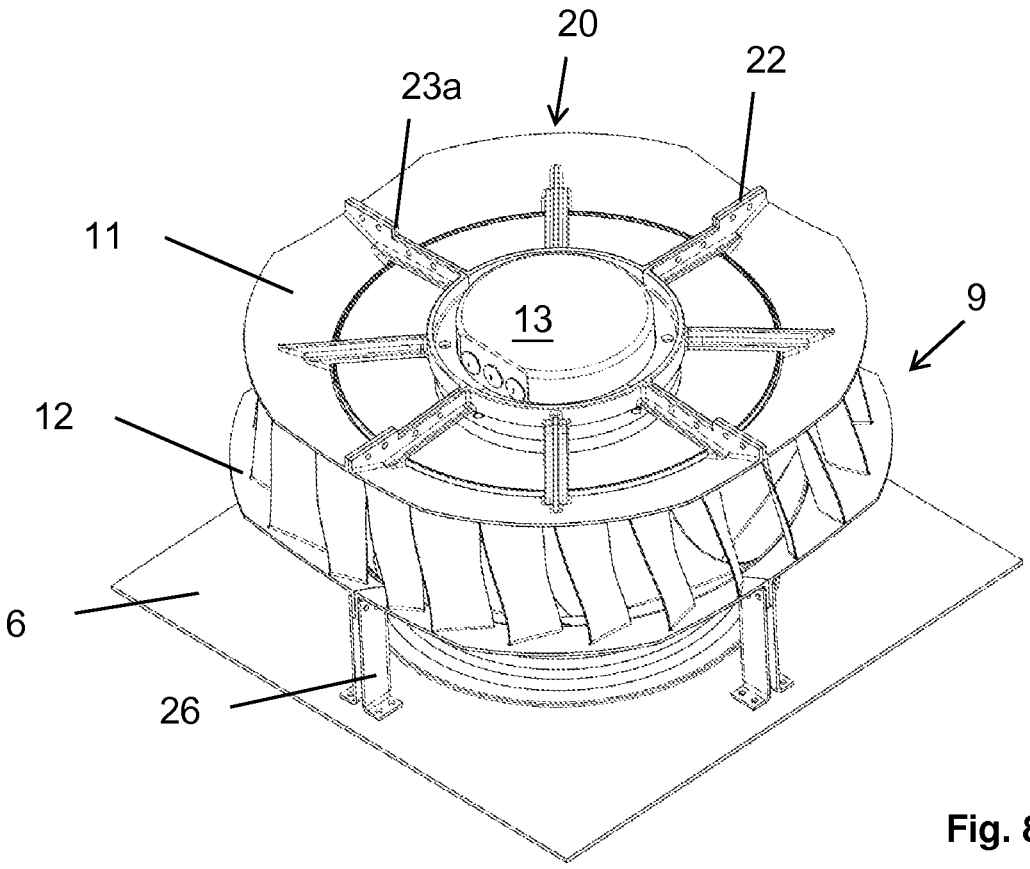
Figure 9A:
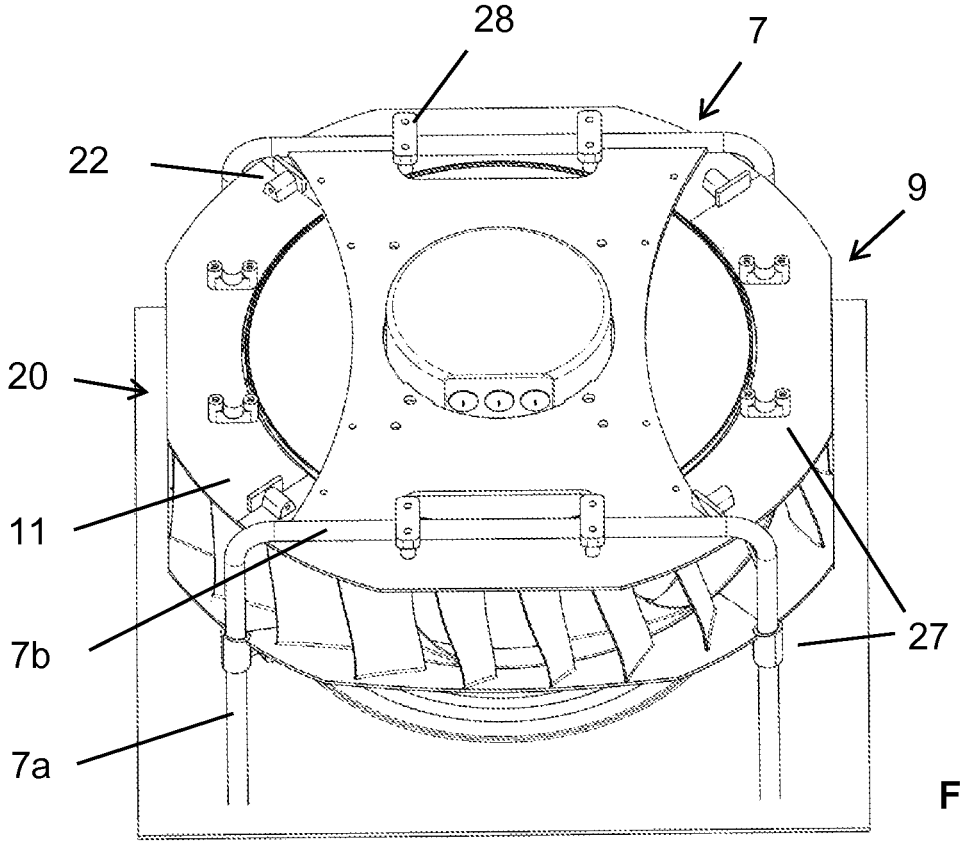
Figure 9B:
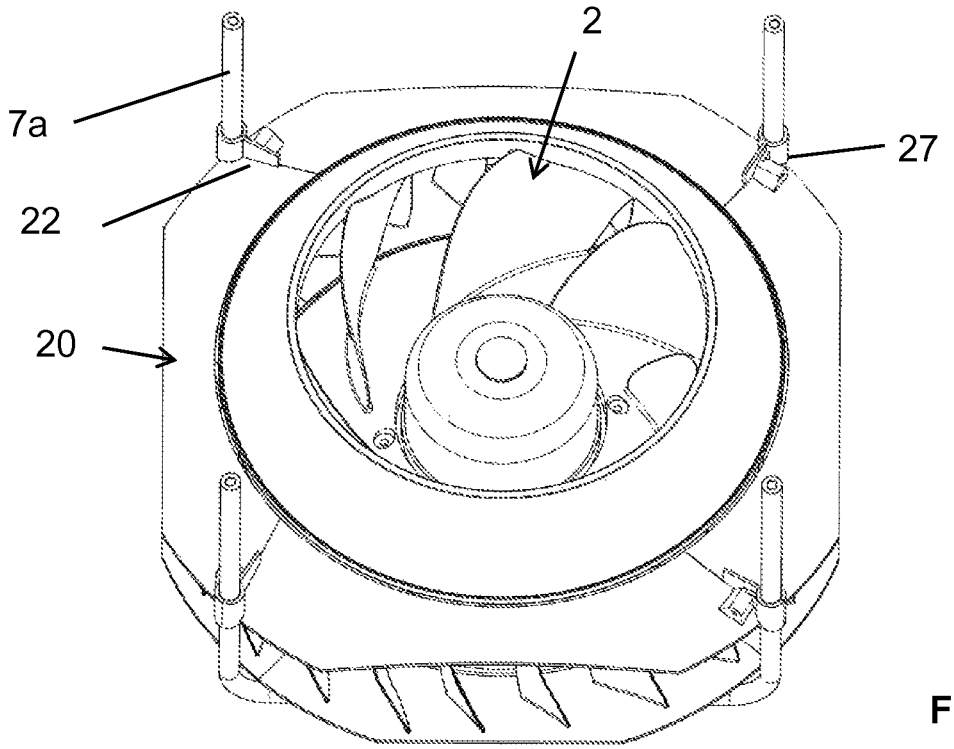
Figure 10:
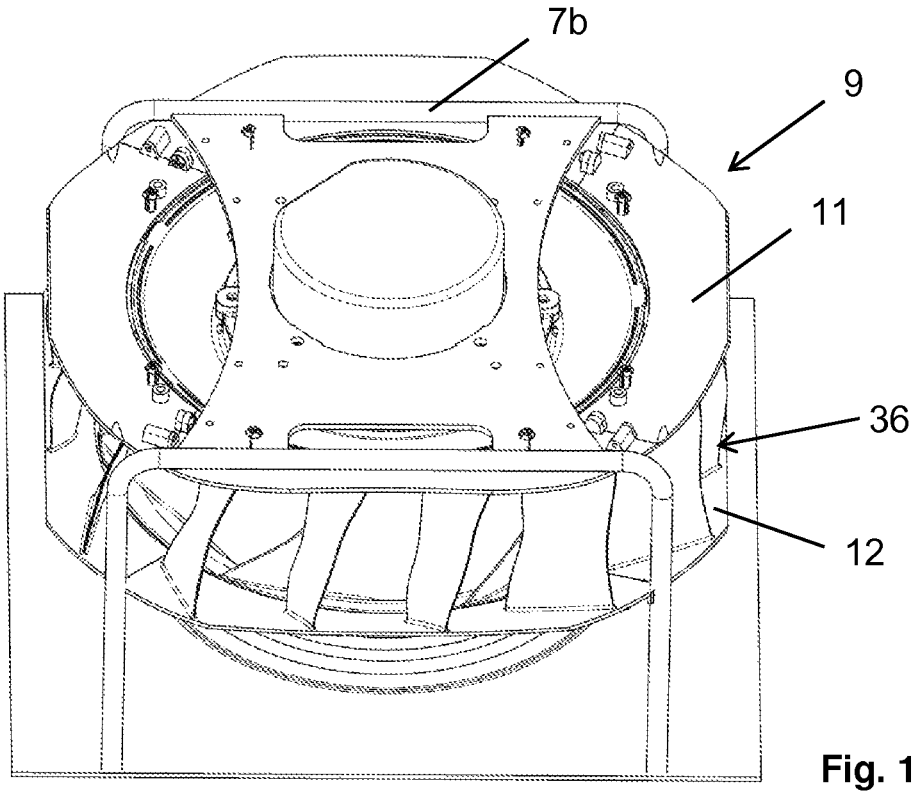
Figure 11:
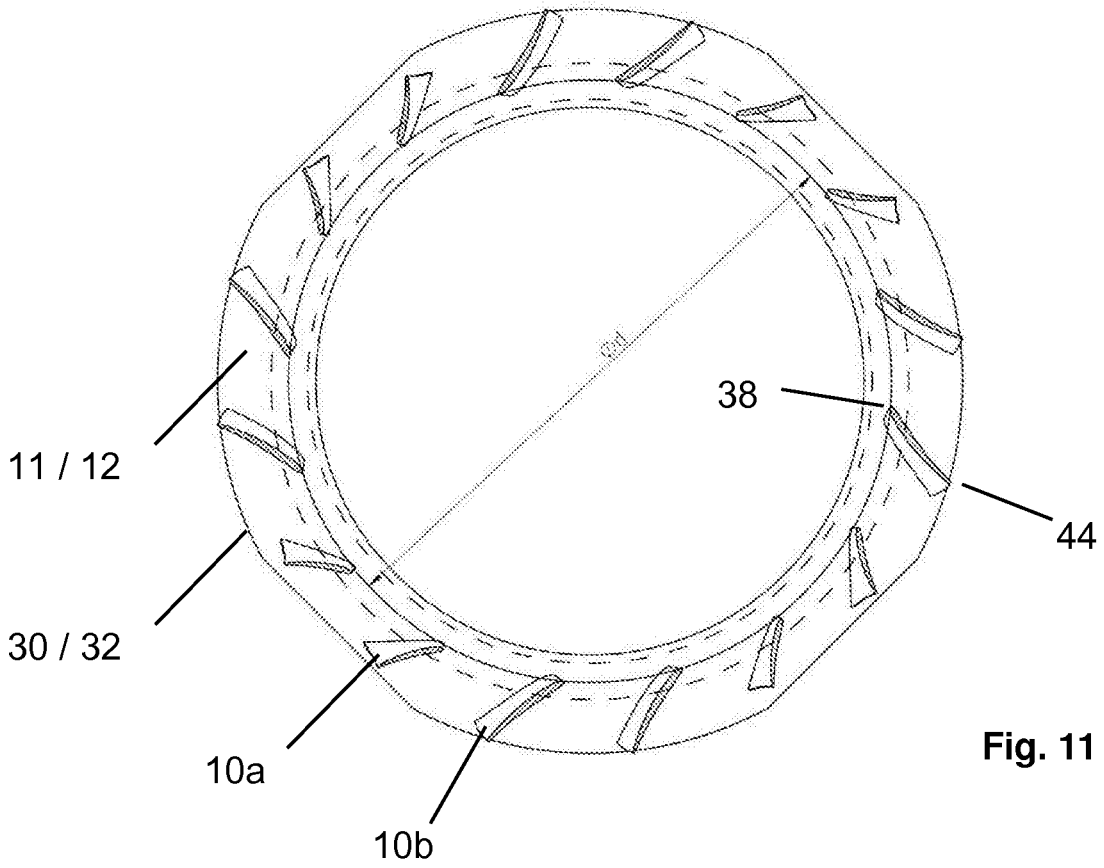
Figure 12A:
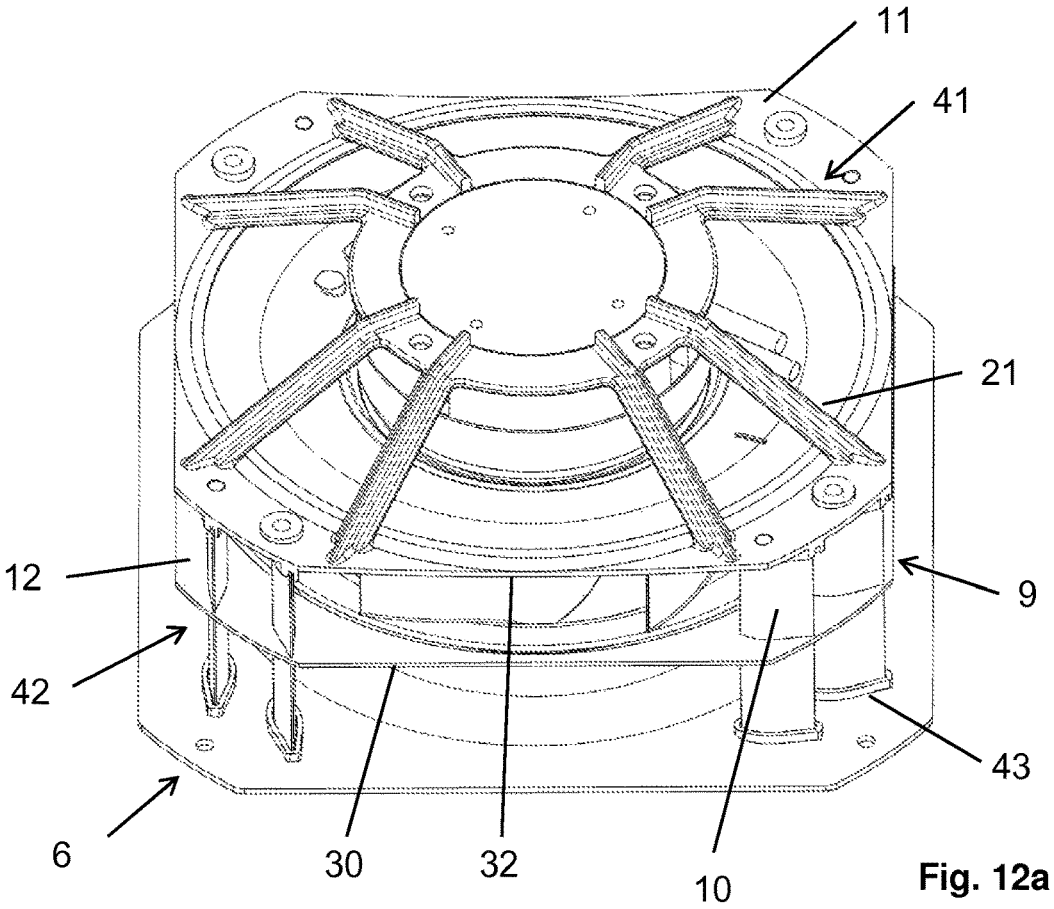
Figure 12B:
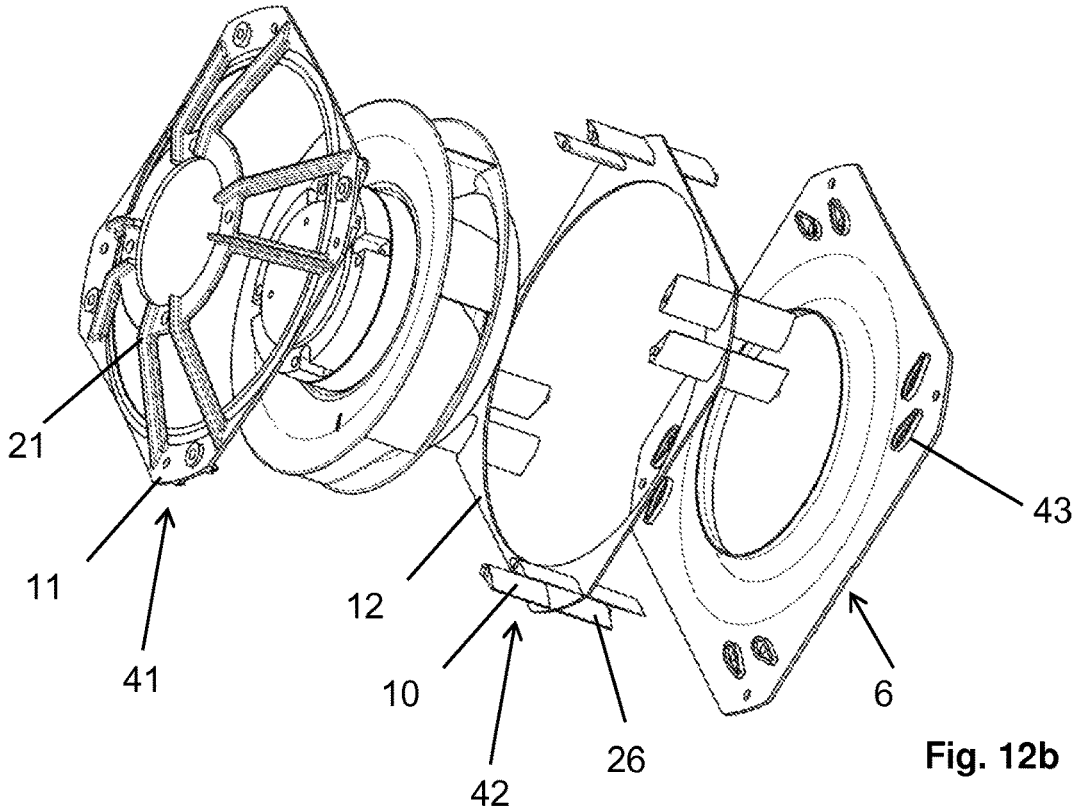
Figure 13:
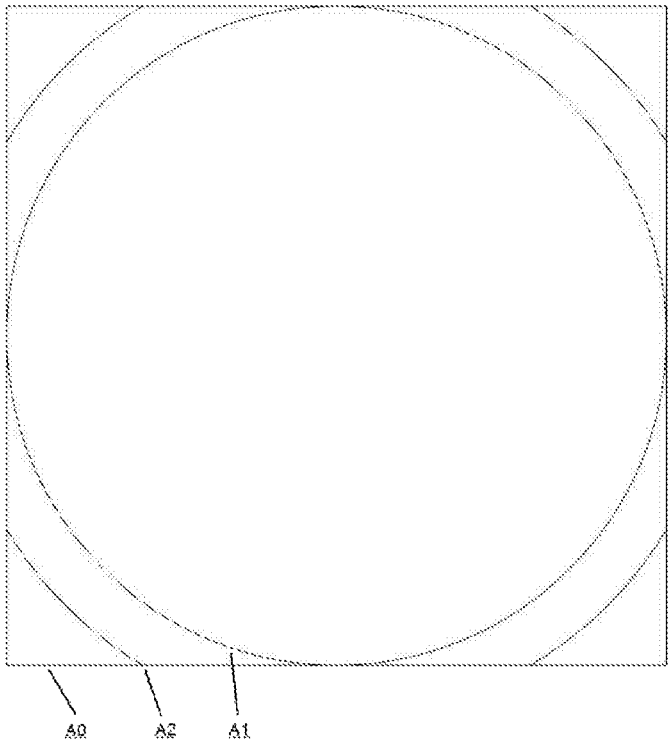

FIG. 1*a* shows in a perspective view an exemplary embodiment of a state of the art compact motor fan wheel of diagonal design, wherein the motor is an external rotor motor, FIG. 1*b* shows in a perspective view an exemplary embodiment of a state of the art free-running radial fan with flat material brace suspension, FIG. 1*c* shows in a perspective view a state of the art motor fan wheel of a free-running diagonal fan with spinning suspension, FIG. 2*a* shows in schematic view the flow-conducting part of an exemplary embodiment of an inventive guide device with circular edges of the cover plate and base disk on the outlet, FIG. 2*b* shows in a schematic view the flow-conducting part a further exemplary embodiment of an inventive guide device with preferably rectangular edges of the cover plate and base disk on the outlet in the projection to a plan perpendicular to the axis of symmetry, FIG. 3*a* shows in a schematic front view a motor fan wheel of diagonal design with the flow-conducting part of an inventive guide device, FIG. 3*b* shows in a schematic lateral view, sectioned with a plane through the axis of rotation, the subject matter from FIG. 3*a*, FIG. 4 shows in a schematic detailed view in section the transition of cover plate/base disk of the impeller and of the guide device of an inventive fan, FIG. 5*a* shows in a schematic detailed view in section the gap on the transition between the cover plate/base disk of the impeller and the cover plate/base disk of the guide device of an inventive fan, FIG. 5*b* shows in a schematic detailed view in section a labyrinth seal on the transition between the cover plate/base disk of the impeller and the cover plate/base disk of the guide device of an inventive fan, FIG. 6*a* shows in a perspective view a segment of an exemplary embodiment of an inventive guide device consisting of several segments with single piece integrated guide device-motor fastening, FIG. 6*b* shows in a perspective view a segment of a further exemplary embodiment of an inventive guide device consisting of several segments with single piece integrated guide device-motor fastening, FIG. 6*c* shows in a perspective view a further embodiment of an inventive guide device consisting of several segments with guide device-motor fastening made of sheet metal, FIG. 7 shows in a perspective view an inventive guide device with supporting function, FIG. 8*a* shows in a perspective view an exemplary embodiment of an inventive fan, wherein the guide device has a supporting function, FIG. 8*b* shows in a perspective view a further exemplary embodiment of an inventive fan with supporting guide device, wherein the guide device consists of several segments and preferably has a rectangular shape, FIG. 8*c* shows in a perspective view a further exemplary embodiment of an inventive fan with supporting guide device of several segments with preferably rectangular shape, wherein sheet metal braces are provided there for connecting the guide device to the nozzle plate, FIG. 9*a* shows in a perspective view an exemplary embodiment of an inventive diagonal fan with non-supporting guide device and spinning suspension, wherein the guide device is fastened on the spinning suspension there, FIG. 9*b* shows in a perspective view, from the front, the subject matter from FIG. 9*a*, without showing the nozzle plate, FIG. 10 shows in a perspective view an exemplary embodiment of an inventive diagonal fan with non-supporting guide device and spinning suspension, wherein the guide device is fastened on the spinning suspension there and is wavy seen in axial direction on the outlet, FIG. 11 shows in a schematic view a section perpendicular to the axis of symmetry through the flow-conducting part of an inventive guide device, FIG. 12*a* shows in a perspective view an exemplary embodiment of an inventive radial fan with supporting guide device, consisting of two parts, FIG. 12*b* shows in an exploded view the subject matter of FIG. 12*a*, FIG. 13 shows a schematic representation for explanation of the term "preferably rectangular" according to claim 4.

FIGS. 1*a*, 1*b* and 1*c* document in particular the prior art, as known from practice.

FIG. 1*a* shows a motor fan wheel 2 of diagonal design. Such a diagonal motor fan wheel or comparably structured diagonal motor fan wheel or a comparably structured radial motor fan wheel is frequently integrated in fans in the known technical practice, as shown for example in FIGS. 1*b* and 1*c*. Likewise such or comparatively structured diagonal motor fan wheels or also comparatively structured radial motor fan wheels can be used with inventive fans, as shown for example in FIG. 3*a*, 3*b*, 8*a*, 8*b*, 8*c*, 9*a*, 9*b* or 10. A motor fan wheel 2 consists essentially of a motor 13 and an impeller 15. The motor 13 is configured as an external rotor motor in the exemplary embodiment.

External rotor motors are frequently used in fans in particular because they permit a compact design. Above all, the extent of a motor fan wheel or of a fan in axial direction can be kept low with the help of external rotor motors. A compact design (both in axial and in radial direction) and hence low space requirements is a quality feature of a fan and frequently a necessary condition for the use of a fan in a higher-level system. An impeller 15 in turn consists essentially of an impeller cover plate 17, an impeller base disk 16 and blades 1, which connect the impeller cover plate 17 and impeller base disk 16 to one another. Impeller cover plates or base disks 17 or 16 of radial or diagonal fans each have an outer edge 33 or 34 situated downstream. The intended area, which spans from the edges 33 and 34 of an impeller 15, is referred to as an impeller outlet 4. The total volumetric air flow from the impeller conveyed by the fan in operation passes through this impeller outlet 4.

The angles, in each case measured to a plane perpendicular to the axis of rotation, of the impeller cover plate or base disk 17 or 16 on the respective outer edge 33 or 34 as a rule largely determine the downstream flow angle between the outflow from the impeller 15 in operation, seen in the projection to a plane through the axis of rotation. This downstream flow angle permits the classification of whether it is diagonal or radial design. If it is greater than 20°, then it is an impeller of diagonal design, otherwise it is an impeller of radial design. An impeller 15 can be produced one piece, in particular in plastic injection molding, or can be produced in various ways in multiple parts.

Impeller cover plates and base disks 17 and 16 are ordinarily configured essentially as solids of rotation with respect to the axis of rotation of the impellers 15, as is also the case with the impellers according to FIGS. 1*a* through 1*c*. In particular, also impeller cover plates and base disks are meant which have slight deviations from ideal solids of rotation, such as for example boreholes, provisions for fastening balancing weights, lettering, production tolerances, stiffening elements, ribs or the like. The outer edges 33 and 34 of the impeller cover plate or base disk consequently have essentially the geometric shape of a circle, whose center point lies on the axis of rotation of the impellers 15. Points of intersection of the blade rear edges 37 of all blades 1 with any plane lie perpendicular to the axis of rotation of the impeller, if available, essentially on a circle, whose center point lies on the axis of rotation.

FIG. 1*b* shows in a perspective view a free-running radial fan with backward curved blades 1. A radial or diagonal fan is referred to as free-running whenever no flow-conducting elements are arranged downstream of the impeller outlet 4 such as for example a spiral housing, diffusers or outlet guide vanes. The radial fan consists essentially of a nozzle plate 6, a motor fan wheel 2 of radial design, flat material braces 3 and a motor supporting plate 5, upon which the motor fan wheel 2 is fixed. The nozzle plate 6 consists essentially of an inlet nozzle 14 and a plate part 39. The inlet nozzle 14 has the aerodynamic function of accelerating the air suctioned by the impeller 15 in front of the impeller inlet. The plate part 39 is usually the mechanical interface to a higher-level system, which means the fan is fastened to the plate part 39 on a higher-level system. The inlet nozzle 14 and plate part 39 can be produced integrally as a single part, for example out of sheet metal, or can be two single parts joined together. The motor supporting plate 5 and the flat material braces 3 together assume the function of the suspension, which means the fixation of the axis of rotation and the axial position of the motor fan wheel 2 in a specified relative position to the nozzle plate 6. This fixation must be ensured in the case of the idle state, operation, storage and transportation of a fan. Similar embodiments belong to the prior art, in which the function of the flat material braces 3 is assumed for example by hollow section braces or the like. The motor supporting plate can deviate from the essentially rectangular shape, in particular through recesses.

FIG. 1*c* shows in a perspective view a free-running diagonal fan with backward curved blades 1. The diagonal fan consists of a nozzle plate 6, a motor fan wheel 2 of diagonal design and a spinning suspension 7. The spinning suspension typically consists of axial braces 7*a* and cross braces 7*b*, which are usually constructed of round or tubular material, as well as one or more motor support plates 8. The spinning suspension 7 assumes the function of suspension. Spinning suspensions, due to the low cross-sectional area and to a large extent smoothness of the axial braces 7*a*, which run downstream of the impeller outlet 4, have the advantage that a lower obstruction and/or turbulence of the outflowing air is achieved than is the case for flat material braces 3 as in the fan in accordance with FIG. 1*b*, which yields advantages in air-flow rate, efficiency and/or acoustics. In other respects the structure of FIG. 1*c* is comparable with that of FIG. 1*b*.

Radial or diagonal fans, such as for example those according to FIG. 1*b* or 1*c*, are typically installed in higher-level systems. Examples of higher-level systems are air-handling units, heat pumps, ventilation systems, evaporators, condensers, generators or electronic cooling systems. In a higher-level system, in which they are installed, the fans frequently have a specified maximum available space viewed in axial and/or radial direction. The minimization of the space requirements of fans or their adaptation to an existing available space is therefore frequently of weighty interest for providers of such fans. This also applies for the inventive fans or guide device described in the following. In the case of typical radial or diagonal fans commonly in use, such as for example those according to FIG. 1*b* or 1*c*, the space requirements can be roughly estimated by a rectangular shaped bounding volume, wherein the cuboid in the exemplary embodiments is characterized by the flat material braces 3 or the axial braces 7*a* of the spinning suspension 7. In the process, the extent of the nozzle plate 6 in radial direction can be disregarded. The elements 3 and 7*a* envelop, for one thing, in radial direction the complete motor fan wheel 2. In axial direction, for another thing, they bridge the distance between nozzle plate 6 and the connection plane of the motor 13. In addition to cost and production aspects, one main reason for the rectangular shaped bounding volume is the possibility arising therefrom of arranging several fans with little or no distance to one another on top and next to one another in space saving manner, namely in the storage, transportation or in particular installed in a higher-level system with several parallel operated fans. Among other things, due to the rectangular shaped bounding volume of such fans the available installation space of existing higher-level systems is often designed rectangular shaped.

The invention is based on the idea deviating from the concept of the free-running radial or diagonal fans according to FIGS. 1*b* and 1*c* and creating fans that have an operating guide device arranged downstream from the impeller 15. With such guide devices the air-flow rate, the efficiency and/or the acoustic behavior of a radial or diagonal fan can be improved. At the same time, such a guide device should not excessively increase the space requirements of the fan, i.e. the fan should remain relatively compact. The observance of a somewhat rectangular shaped bounding volume can be of particular interest with respect to compactness for the reasons described above. It should also be possible to cost-effectively produce the guide device. The guide device can in the case of some embodiments assume the function of suspension, that means flat material braces or braces of the spinning suspension can then be completely or partly replaced.

FIG. 2*a* shows in a perspective view the flow-conducting part of an exemplary embodiment of an inventive guide device 9, wherein guide blades 10 are arranged there between a guide device base disk 11 and a guide device cover plate 12 and firmly connected to them. The guide device cover plate has an inner edge 29 situated upstream as well as an outer edge 30 situated downstream. The guide device base disk has an inner edge 31 situated upstream as well as an outer edge 32 situated downstream. The intended area, which spans from the inner edges 29 and 31 of the guide device 9, is referred to as a guide device inlet 35. The intended area, which spans from the outer edges 30 and 32 of the guide device 9, is referred to as a guide device outlet 36. At least the majority of the total volumetric air flow conveyed by the impeller in operation passes through the guide device inlet 35 into the guide device 9. At least the majority of the total volumetric air flow conveyed by the impeller in operation passes through the guide device outlet 36 out of the guide device 9. In accordance with the representation in FIG. 2*a* the edges 29, 30, 31, 32 of the guide device base disk 11 or of the guide device cover plate 12 circular in design. The guide blades 10 are identical to one another in geometry. The distribution of the guide blades 10 is uniform viewed over the periphery of the guide device cover plate 12 and guide device base disk 11, that means, the distance measured in circumferential direction between adjacent guide blades 10 is always identical.

FIG. 2*b* shows in a perspective view the flow-conducting part of a further exemplary embodiment of an inventive guide device 9, wherein here the edges 30, 32 assigned to the guide device outlet 36 do not have a circular geometry. In the projection onto a plane perpendicular to the axis of symmetry the edges 30, 32 have a preferably rectangular geometry. The result is that the distance of the edges 29 and 30 or 31 and 32, which defines the extent of the guide device cover plate 12 or guide device base disk 11 in the direction of throughflow, varies over the circumference. In regions which are preferably to be assigned to the corners of the preferably rectangular geometry in the projection, the extent of the guide device cover plate 12 and guide device base disk 11 in the direction of throughflow is hence greater, while this extent is lesser in regions which are preferably to be assigned to the sides of the preferably rectangular geometry in the projection. Also in this exemplary embodiment all guide blades 10 are identical to one another in their geometry. The distribution of the guide blades 10 is largely uneven viewed over the circumference of the guide device cover plate 12 and guide device base disk 11, which means, the measured distance in circumferential direction between adjacent guide blades varies. In regions that are preferably to be assigned to the corners of the described preferably rectangular geometry in the projection there is an accumulation of the guide blades 10. In regions that are preferably to be assigned to the sides of the described preferably rectangular geometry in the projection there is a there is a depletion of the guide blades 10, there are none over a wide region. This is due to the fact that in this region because of the low extent of the guide device cover plate or guide device base disk in the direction of throughflow there is only insufficient space for the attachment of further guide blades. In the case of further embodiments, for example the embodiment shown in FIG. 6*c* or also FIG. 11, guide blades 10*a*, 10*b* can differ from one another in their geometry. In particular, guide blades 10*a* have a lesser extent in the direction of throughflow than guide blades 10*b* have. Shorter guide blades 10*a* are preferably located in regions to be assigned to the sides of the preferably rectangular geometry in the projection. Longer guide blades 10*b* are preferably located in regions to be assigned to the corners of the preferably rectangular geometry in the projection. It is advantageous, as the exemplary embodiments show, that the guide device cover plate and guide device base disk 12, 11 have a greater extent in the direction of throughflow than the guide blades 10. In particular it is advantageous if the guide blade rear edges 44 completely or to a large extent upstream of the guide device outlet 36.

The maximum diameter of the outer edges 30, 32 of the guide device cover plate and guide device base disk 12 or 11 is in the case of advantageous embodiments in each case 10%-50% greater, for especially high efficiency requirements 20%-50% greater, than the diameter of the respective corresponding edge 33 or 34 of the impeller cover plate or base disk 17 or 16.

FIG. 11 shows in a schematic view a section through an inventive guide device 9, for example in accordance with one of FIG. 2*a* or 2*b*, on a plane lying perpendicular to the axis of symmetry in the region of the flow-conducting part of the guide device 9. In addition, three circles concentric with the axis of symmetry are indicated schematically. The middle circle, drawn as a continuous line describes the mean diameter of the guide blade front edges 38 of all guide blades 10, 10*a*, 10*b* of the guide device 9. This mean diameter can vary in the spanwise direction of the guide blades 10, 10*a*, 10*b*, that means, depending on the selected sectional plane. The circles in dashed lines have a diameter deviating by about +7% or −7%. It can be seen that all points of intersection of the guide blade front edges 38 of the exemplary embodiment with the selected sectional plane lie in this tolerance range. In the case of especially advantageous embodiments these diameters (per sectional plane or position in spanwise direction) all lie within a tolerance range of +/−2% of the mean diameter. This means in the case of a fan in operation that the blade rear edges 37 of all blades 1 in the case of the rotation of the impeller 15 each sweep past at a distance to the guide blade front edges 38 of all guide blades 10 10*a*, 10*b* similar to one another.

At each point of a guide blade front edge 38 of a guide blade 10, 10*a*, 10*b* a minimum distance dS can be specified, that said point occupies in the course of a rotation of the impeller 15 to a blade rear edge 37 of one of the blades 1 of the impeller 15. In general, this distance dS can vary in spanwise direction and also for the different guide blades 10, 10*a*, 10*b*. In the case of advantageous embodiments this minimum distance dS for every position in spanwise direction and every guide blade 10, 10*a*, 10*b* lies in the range of 0.5%-5% of the impeller diameter, which is defined as the diameter of the circular edge 33 of the impeller cover plate 17. The selection of very small distances dS in the range of 0.5%-2% of the impeller diameter is advantageous for the space requirements of the fan, the efficiency and the air-flow rate. With respect to noise emissions in operation, the selection of greater distances dS in the range of 2%-5% of the impeller diameter can be advantageous.

The blade number of inventive guide devices can lie between 8 and 30, advantageously between 10 and 25. The outer contour of the guide device base disk 11 and of the guide device cover plate 12 can be adapted to the respective requirements, namely for example in accordance with the representations in FIGS. 2*a* and 2*b*.

In FIG. 11 it can be seen that, viewed in section the guide blades 10 have a geometry similar to that of an airfoil profile. In particular these sections of the guide blades 10 deviate greatly from ellipses, rectangles, crosses or other rotationally symmetrical or mirror-symmetrical contours. These sections are rounded off at the guide blade front edges 38. Up to the region of the guide blade rear edges 44 there are no edges and corners. The sections have rather a think, slim shape. One can imagine, per section, in known manner a center line (median line), which angles $\gamma 1$ or $\gamma 2$ enclose with the circumferential direction on guide blade front edges 38 or guide blade rear edges. Advantageously $\gamma 2 > \gamma 1$. Advantageously $\gamma 1$ and $\gamma 2$ lie in the range of 10° to 80°. The extent perpendicular to the median line (thickness) is not constant, but rather, viewed from the front edge region, increases first, in order then, from a place of maximum thickness, in the course up to the rear edge to decrease to a lesser value. Embodiments are also conceivable, in particular in the case of guide devices with supporting function, in which case the guide blades 10 when viewed in section do not have the geometry of an airfoil, but rather simpler geometries such as for example circles, ellipses, rectangles, crosses or the like. However, such embodiments have a lower efficiency increase than embodiments with airfoil profile cross-section.

The definition of the term "preferably rectangular" for the purpose of a possible design of the guide device outlet edges 30 and 32, in the projection to a plane perpendicular to the axis of symmetry, will be clarified in the following with the help of FIG. 13. A0 represents an exact rectangular area. To a certain extent, this area characterizes the maximum available installation space in this projection or viewing direction. A1 and A2, likewise in this projection, represent possible designs of the edges 30 or 32, neither of which are exactly rectangular. A0 is always the rectangle of minimum area which completely contains the respective implementation of the mentioned edges 30 or 32 in this projection, such as for example A1 and A2. A1 represents an ellipse, which is not considered rectangular. The area ratio A1/A0 is, as for all ellipses and in particular the circle, about 79%. A2 represents the edge of an area that is greater than that of A1 and whose minimum described rectangle is likewise A0. In this sense, in comparison to A1 A2 preferably has a rectangular design. For the purpose of the invention an area A and within this meaning also its edge is referred to as "preferably rectangular", if A/A0>80%, advantageously A/A0>90%. The space requirements or the outer form of an inventive fan or of an inventive guide device is referred to as preferably rectangular shaped, if the design of the guide device outlet edges 30 and 32, in the projection to a plane perpendicular to the axis of symmetry within the meaning of the given definition is "preferably rectangular". As a rule namely the projection of the guide device outlet edges 30 and 32 on a plane perpendicular to the axis of symmetry defines the space requirements of an inventive fan seen in viewing direction of the axis of rotation. The space requirements of a nozzle plate 6, which seen in this viewing direction as a rule radially has a greater extent hat than the remaining part of the fan, in the process has a different role to play and can be excluded in this approach.

The flow-conducting parts of the guide devices 9 according to FIGS. 2*a* and 2*b* can be produced in one piece (monolithic), in particular in plastic injection molding or metal casting. As shown in the following figures, even further function elements can be integrated in a single piece in the guide devices 9, such as for example braces or the like. The flow-conducting parts of the guide devices 9 can also be produced in several pieces, for example of several segments from plastic injection molding or metal casting, which can be connected to one another appropriately, or as a sheet metal construction, wherein guide blades 10 are welded, strapped, screwed, Tox-clinched, riveted, bonded or the like to guide device base disk and cover plate 11, 12 or the like.

FIG. 3*a* shows an inventive guide device 9 with a motor fan wheel 2 of diagonal design installed therein in schematic view, at an angle from the front. The electric motor 13, the impeller 15 and guide device 9 extending radially outward or joining the impeller 15 are visible. Essentially the same statements apply for the motor fan wheel 2 that have been made about the prior art according to FIGS. 1*a*-1*c*. The guide device 9 comprises the guide device base disk 11 and the guide device cover plate 12. The previously mentioned guide blades 10 are arranged in between. The motor fan wheel 2 is arranged in the guide device 9 such that the axis of rotation of the impeller 15 coincides with the axis of symmetry of the guide device 9.

FIG. 3*b* shows the subject matter from FIG. 3*a* in a schematic lateral view, sectioned with a plane through the axis of rotation. FIG. 3*b* shows particularly clearly that the guide device base disk 11 and the guide device cover plate 12 are an essentially continuous and tangentially constant elongation of the impeller base disk 16 and the impeller cover plate 17 of the impeller 15. As a result, an especially favorable situation with regard to flow arises in accordance with the statements in the general description. For better diversion or continuation of the flow after the guide device outlet 36 in the diagonal direction, in the shown exemplary embodiment the mean axial distance of the outer edge 30 of the guide device cover plate 12 greater than or equal to the mean axial distance of the outer edge 32 of the guide device base disk 11. Advantageously these mean axial distances have a ratio in the range of 1.0-1.2. A diagonal outflow direction is important, in particular in the use of an inventive fan in a higher-level system, in which the flow to the outlet from the fan is transferred in a preferably axis-parallel manner, for example through flow impermeable walls at more or less short intervals radially outside downstream of the fan.

$\beta 1$ and $\beta 2$ describe, viewed in section, the angles between the guide device cover plate or base disk 12, 11 in the region of the guide device outlet 36 and a plane perpendicular to the axis of rotation. The downstream flow angle $\beta$ viewed in section lies in a range between $\beta 1$ and $\beta 2$. The diagonal direction is characterized by great downstream flow angles $\beta > 20°$. If $\beta 2$ and $\beta 1$ are approximately equally great, the guide device cover plate and base disk 12, 11 run approximately parallel on the guide device outlet. For $\beta 2 > \beta 1$ the guide device cover plate and base disk 12, 11 on the guide device outlet diverge from one another. As a result, an additional enlargement of the flow cross-section and hence an additional flow deceleration to the guide device outlet is achieved, which can lead to additional static pressure recovery and hence efficiency increase. However, if one selects to great of a difference for $\beta 2 - \beta 1$, the flow to guide device cover plate and/or base disk 12, 11 separates and there is deterioration in efficiency, pressure buildup and acoustics. Particularly advantageous is the selection $0° \leq \beta 2 - \beta 1 \leq 20°$.

In other words the respective base disks 11, 16 and cover plates 12, 17 are flush with one another, wherein the guide device 9 is attached nearly gap free to the impeller 15 of the fan device 2. The guide device 9 is to be understood within the meaning of an outlet guide and diffuser unit, namely in order to reduce the flow speeds of the flow exiting from the impeller 15 and to convert the dynamic pressure associated with the flow speeds, usually not usable, into usable static pressure. As a result, the efficiency and/or the air-flow rate of the fan are increased.

Embodiments are also conceivable in which case the guide device base disk 11 and the guide device cover plate 12 are an essentially continuous, but not tangentially constant elongation of the impeller base disk 16 and the impeller cover plate 17 of the impeller 15. Dispensing with tangent continuity, in particular in the transition of the base disks 16 and 11, can yield critical advantages with respect to compactness or space requirements of the guide device viewed in axial or radial direction.

FIG. 4 shows as the detail of a section on a plane, which contains the axis of rotation, similar to that of FIG. 3*b*, the transition of the cover plate or base disk 16, 17 of the impeller 15 to the guide device base disk 11 or guide device cover plate 12 of the guide device 9. FIG. 4 indicates that the cover plate/base disk 12, 11 of the guide device 9 runs approximately in continuous elongation to the cover plate/base disk 17, 16 of the motor fan wheel 2 or of the impeller 15. With an angle $\alpha$ unequal to 0° a deviation from the ideal tangent continuity in terms of flow ($\alpha = 0°$) is quantified. The selection $-15° < \alpha < +15°$ is particularly advantageous. The selection $\alpha \neq 0°$ can yield advantages above all with regard to space requirement minimization of the guide device 9 or of the fan with equal length of the guide device cover plate or base disk 12 or 11 in the direction of flow. In the process $\alpha > 0°$ (as drawn) preferably leads to a more compact radial design, $\alpha < 0°$ preferably leads to a more compact axial design.

FIG. 5*a* shows as the detail of a section on a plane, which contains the axis of rotation, similar to that of FIG. 3*b*, the transition of the cover plate or base disk 17, 16 of the impeller 15 to the guide device cover plate 12 or guide device base disk 11 of the guide device 9. FIG. 5*a* shows the gap 18 between the impeller 15 and the guide device 9 or between the respective cover plates or base disks 17 and 12 or 16 and 11. The gap 18, which extends between the edges 33 and 29 or 34 and 31, ensures that the impeller 15 and guide device 9 in operation, in which case the impeller moves in circumferential direction vis-à-vis the guide device, do not touch. For reasons of production tolerances, assembly tolerances, oscillations, balancing weights or deformations in operation, this gap must have at least a certain minimum clearance. However, inadvertently the gap 18 causes a leakage volume flow, ultimately resulting in a lessening of air-flow rate and efficiency as well as an increase in the noise emissions. Therefore, the clearance of a gap 18 by the same token should be as small as possible and preferably lie in the range of 0.5%-2% of the impeller diameter. Clearance means the minimum distance of the impeller cover plate or base disk 17 or 16 to the guide device cover plate or base disk 12 or 11.

By using a labyrinth seal 19, such as for example shown in FIG. 5*b*, the leakage volume flow on the gap 18 can be further reduced or nearly avoided, in order as a result to achieve higher air-flow rates and/or higher efficiencies and/or lower noise emissions. It is also conceivable to achieve a similar effect as in the case of a labyrinth seal 19 through a lateral overlapping between the cover plates or base disks of the impeller 15 and of the guide device 9.

In particular to reduce tooling cost, embodiments of the inventive guide device 9 can be constructed of several segments, FIGS. 6 and 8 show. In the case of design in multiple parts of the guide device 9 the segments 20 can be made of plastic, metal or a combination of the two materials.

FIGS. 6*a* and 6*b* each show a segment 20 of a guide device 9 consisting of segments. This guide device 9 has, in addition to the flow-conducting part consisting of guide blades 10, guide device cover plate and base disk 12, 11 a guide device motor connection 21. In the exemplary embodiment according to FIG. 6*a* this consists of several motor connection braces 23 and a motor connection flange 40. The guide device motor connection 21 is produced per segment in a single piece with the flow-conducting part in the exemplary embodiment, advantageously in plastic injection molding. The braces have roughly the shape of a T profile in cross-section, which brings high flexural rigidities in accordance with the requirements for an injection molded part, namely in particular somewhat constant wall thicknesses. Boreholes are provided on the motor connection flange 40, on which a motor 13 can be attached. The inner edge of the motor connection flange 40 can be used for centering in the assembly of the motor 13.

The number of segments, of which a guide device 9 is built, can range from 2-8. Advantageously all segments are identical, or at least similar, so that they can be produced with the same molding tool. Slight variations between the segments can be achieved if required by tool change inserts or subsequent machining. The number of guide blades 10 is advantageously a multiple of the number of segments. A number of segments of 4 prove to be particularly advantageous. For one thing it constitutes a good compromise between molding tool size and joining expenditure in the joining of the segments. For another thing this number is ideally suited for building a preferably rectangular form of the guide device from identical or similar segments. The number of the guide blades 10, 10*a*, 10*b* per segment is advantageously 4, which has proven to be a good compromise between tooling cost, compactness, efficiency increase and acoustics.

The joining of the segments 20 to a guide device 9 can take place by welding, strapping, screwing, Tox-clinching, riveting, bonding, snap-on hooking, a snap-on connection or the like. In the case of the exemplary embodiment of a segment according to FIG. 6*a* a joint 22 is configured which provides an especially large joining area, at least greater than the one that would be present through mere separation of the guide device cover plate or base disk 12, 11. Large joining areas are in this sense helpful in the case of most of the mentioned joining method and are required for stability. This applies in particular also for screw or rivet connections, in which case the joining area 22 can be used for the placement of corresponding boreholes. In addition, centering aids for the joining of the segments can be fixed to the joints 22, for example in the form of pins, cones, brackets, snap hooks, tongue and groove joints. The centering aids simplify the assembly and among other things ensure a secure connection in the case of the subsequent joining. Moreover, there is the possibility of providing further fastening elements on the joints 22, for example sheet metal parts, which provide for connection to the nozzle plate 25 and/or the motor 13.

FIG. 6*b* shows a segment 20 of a similar embodiment like FIG. 6*a* with integrated guide device motor connection 21. The joint 22 of the segments 20 here however runs precisely through some of the motor connection braces 23*a*, which are divided accordingly. As a result, a further considerable enlargement of the joining area of the joint 22 is achieved. In addition, the joints 22 between the respective adjacent segments 20 can be used for the attachment of further metal sheets, braces, brackets etc. without significantly increasing the assembly expense.

Similar embodiments of inventive guide devices such as those according to FIGS. 6*a*, 6*b* can also be implemented in a single piece, thus not segmented.

FIG. 6*c* shows a guide device 9 built of 4 segments 20 with a sheet metal guide device motor connection 24. Here the segments 20 are preferably produced from plastic injection molding. The sheet metal guide device motor connection 24 is not produced segmentally in one piece with the segments 20, but rather consists of 4 separately produced, identical sheet metal parts, which are connected to the segments 20 in the region of the joints 22. The region of the inner edge of the sheet metal guide device motor connection 24 is provided for the centering and fixation of a motor 13. One advantage of this embodiment over those according to FIGS. 6*a* and 6*b*, which are otherwise built similarly, is the simpler design of the injection molding tool for the segments 20 as well as the, depending on design, higher stability.

The embodiment shown in FIG. 6*c* has, in particular in its chord length, guide blades 10*a* and 10*b* differing from one another. The number of guide blades 10*a* and the number of guide blades 10*b* are both multiples of the number of the segments 20. Whether differing or identical guide blades 10 or 10*a* and 10*b* are present is not causally connected to the Embodiment with integrated guide device motor connection 21 or separate sheet metal guide device motor connection 24. In the case of other embodiments more than two differing guide blade geometries can be present.

It is also conceivable to have a similar embodiment such as the one according to FIG. 6*c* without a construction of segments 20. Then the flow-conducting part of the guide device 9 can be a single-piece injection molded part, and the sheet metal guide device motor connection 24 can be a single-piece or multiple piece sheet metal.

The embodiments according to FIGS. 6*a*-6*c* show exemplary embodiments of the guide devices with a possible connection of the motor 13 to the guide device 9. Such embodiments can be used in particular with non-supporting guide devices. In these cases the connection of nozzle plate and motor is brought about by a suspension, for example a spinning suspension 7 or flat material braces 3 to the motor supporting plate 5. The guide device 9 is then fastened with the described possible connections on the motor 13. The guide device 9 must in the case of these embodiments be constructed such that it does not collide with the suspension and can be mounted.

Similar connections of the motor 13 to the guide device 9, as shown in the case of the exemplary embodiments according to FIGS. 6*a*-6*c*, namely guide device motor connection 21 or sheet metal guide device motor connection 24 can also be used in the case of guide devices 9 with supporting function. However, then in contrast to the mentioned embodiments, in addition a connection of the guide device 9 to the nozzle plate 6 must be provided. Exemplary embodiments for guide devices 9 with supporting function are described in the following on the basis of FIGS. 8*a*-8*c* and 12*a*-12*b*. Such guide devices 9 assume, along with the flow functions already described, a supporting function, i.e., at least in the region of the guide blades 9 or radially outside of the guide blades 9 or downstream of the guide device outlet 36 no additional flat material braces 3 and no additional spinning suspension 7 or the like are necessary for the functionality of the fan. The reaction forces and reaction torques from the motor fan wheel 2 are in the case of the assembled fan transferred via the guide blades 10 to the nozzle plate 6. To ensure this, the guide blades must be correspondingly dimensioned with regard to stability.

FIG. 7 shows an inventive exemplary embodiment of a guide device 9. This guide device 9 is in a single part, preferably manufactured from plastic injection molding, and designed to be supporting. The guide device motor connection 21 is essentially identical in design to the segmented exemplary embodiment according to FIG. 6*a*. In addition, nozzle plate connection braces 26 are mounted on the guide device cover plate 12 for connection to the nozzle plate. These nozzle plate connection braces 26 are implemented in the exemplary embodiment with similar cross-section to the motor connection braces 23. The connection of the nozzle plate connection braces 26 to the nozzle plate 6 can for example take place by screwing, riveting, strapping, a snap-on connection, snap-on hooking, a type of bayonet catch or the like. Centering aids such as recesses, guides or the like can be provided on the nozzle plate 6.

In the exemplary embodiment the nozzle plate connection braces 26 are produced in a single piece with the flow-conducting part of the guide device 9, i.e. they are integrated in the guide device 9. This is economical, in particular for smaller dimensions with an impeller diameter of less than 400 mm. However, it is also conceivable that the nozzle plate connection braces 26 are produced as separate plastic or sheet metal parts and can be connected to the guide device 9 in similar manner as to the nozzle plate 6. This is quite suitable in particular in the case of large dimensions with an impeller diameter of more than 400 mm.

FIG. 8*a*-8*c* show embodiments of inventive fans, wherein the guide device in each case has a supporting function. The shown embodiments make it clear once more that the guide device 9 can assume a supporting function, so that the fastening braces generally used in the prior art, for example flat material braces 3 or spinning suspension 7, can be at least partially or completely replaced. The negative effects of the fastening braces used up to now with respect to the air-flow rate, efficiency and acoustics can be eliminated to the greatest possible extent through the advantages of the supporting guide device 9. In concrete terms the previous fastening braces are replaced in the region of the impeller outlet 4 by the bladed guide device 9.

In the case of the embodiment according to FIG. 8*a* the nozzle plate connection braces 26 have a round cross-section. They can be integrated in the guide device 9 in a single piece, in particular in plastic injection molding, or they can be separate parts made of metal or plastic. The guide device 9 is produced in a single piece, preferably in plastic injection molding. The attachment of the nozzle plate connection braces 26 to the nozzle plate 6 and if applicable to the guide device 9 can take place in the previously described manner. The outer edges 30, 32 of the guide device cover plate or base disk 12, 11 are circular in design, and the guide device cover plate and base disk 12, 11 are solids of rotation in the exemplary embodiment. This results in very great improvements in the air-flow rate, efficiency and acoustics, in comparison to the free-running wheel in fans of similar structure to FIG. 1*b* or 1*c*. However, one also sees that the required installation space, in the case of the same motor fan wheel 2, is larger in radial direction than is the case for fans according to 1*b* or 1*c*. In particular, under certain circumstances the inventive fan according to FIG. 8*a* can no longer be installed in a preferably rectangular shaped installation space, as provision was made for fans similar to FIG. 1*b* or 1*c*. Moreover, if one builds several fans of the embodiment according to FIG. 8*a* next to or on top of one another, due to the higher space requirements in radial direction, a greater distance of two adjacent fans must now be selected, which is likewise a disadvantage.

In the case of the embodiment according to FIG. 8*b* the nozzle plate connection braces 26 have a preferably cross-shaped cross-section, similar to those in the exemplary embodiment according to FIG. 7. The guide device 9 is made of 4 segments, which have preferably integrated the guide device motor connection 21 and nozzle plate connection brace 26. The outer edges 30, 32 of the guide device cover plate or base disk 12, 11 are, in the projection to a plane perpendicular to the axis of rotation, preferably rectangular in design. In this sense the guide device 9 or the fan has preferably a rectangular shaped design. The guide device cover plate and base disk 12, 11 in the exemplary embodiment have essentially the geometry of sectioned solids of rotation. In FIG. 8*b* it can be seen that through the preferably rectangular shaped design of the guide device 9 the space requirements of the fan are noticeably reduced. In particular in the critical regions, which are to be assigned to the radially outward lateral areas of the rectangular shaped design, the space requirements are reduced. As a result, the inventive embodiment according to FIG. 8*b* can be installed in a preferably rectangular shaped installation space, as present for fans according to FIG. 1*b* or 1*c*. Moreover, if one builds several fans of the embodiment according to FIG. 8*b* next to or on top of one another, a comparatively small distance between two adjacent fans can be selected. Typically the total number of the guide blades 10 or 10*a*, 10*b* in the case of embodiments of the guide devices 9 with preferably rectangular shaped design is higher than in the case of embodiments of the guide devices 9 with preferably round design such as for example in FIG. 8*a*. Advantageously then the total guide blade number≥16. With such guide devices 9, in spite of the preferably rectangular shaped, compact design a great improvement can be achieved in air-flow rate, efficiency and acoustics. An especially compact design is achieved if, the lateral lengths of the rectangle with respect to the preferably rectangular shape of the outer edges 30 and 32 of the guide device cover plate or base disk 12, 11 in the projection to a plane perpendicular to the axis of rotation are smaller than 1.4 to 1.5 of the impeller diameter, advantageously smaller than 1.1 to 1.25 of the impeller diameter.

FIG. 8*c* shows a further inventive embodiment, similar to the one in FIG. 8*b*. The guide device 9 is built of segments 20 here. The joints 22, as in the exemplary embodiment according to FIG. 6*b*, run through divided motor connection braces 23*a*. The nozzle plate connection braces 26 are implemented as separate sheet metal parts, which are screwed to the guide device cover plate 12 and nozzle plate 6. The screwing to the guide device cover plate 12 takes place in precisely the region of joints 22. As a result, the joining expenditure can be minimized, because with one connection, both adjacent segments 20 are joined to one another as well as also the guide device cover plate 12 to the nozzle plate connection braces 26. The stability is likewise increased. In equivalent manner, in the case of other embodiments one can proceed with the guide device motor connection 21.

FIGS. 9*a*, 9*b* and 10 show inventive embodiments of diagonal fans with non-supporting guide devices 9 in combination with a spinning suspension 7. Thus it is conceivable within the scope of a further embodiment of the inventive guide device 9 to combine it with an already existing spinning suspension 7 according to FIG. 1*c*. Correspondingly the guide device 9 is mounted on the spinning suspension 7 and in this case does not assume a supporting function. The entire motor fan wheel 2 is held or supported by the spinning suspension 7. The installation of the guide device 9 on the spinning suspension 7 can take place via special connection means, which are assigned to the guide device 9 and in the case of advantageous embodiments are produced completely or partially in a single piece in plastic injection molding with the guide device 9. Said connection means can be for example clamping and screwing elements 27, snap-on hooking or the like. The basic structure of the guide device 9 of four segments 20 can also be retained in the case of. It is advantageous in particular for the installation if the joints 22 of the segments are roughly in the region of the braces of the spinning suspension 7. Since typical spinning suspensions 7 have essentially 4 axial braces, the segment number in the case of segmented guide devices 9 is advantageously 4. If required, fastening means 28 can be provided for the installation on the spinning suspension 7. Further fastening possibilities are conceivable.

A further aspect arises from the advantageous procedure of using existing spinning suspensions 7, such as for example in the prior art according to FIG. 1*c*, without any obvious design modification for an inventive fan with non-supporting guide device 9. For one thing, there is the reason that one cannot make the existing spinning suspension 7 larger in axial or radial direction due to the available installation space. For another thing, investment costs can be reduced if existing designs can continue to be used. In particular, it becomes possible to retrofit an inventive guide device 9 on an existing fan according to the prior art in accordance with FIG. 1*c*.

In accordance with the exemplary embodiment according to FIG. 9*a* it becomes clear that in this respect, along with the radial restriction for the design of a guide device 9 through the axial braces 7*a* of the spinning suspension 7 there is an axial restriction for the design of a guide device 9 or of the guide device base disk 11 through the cross braces 7*b*. In any case, viewed in axial direction the impeller base disk 16 is often located close to the motor support plate 8 and hence is axially close to the cross braces 7*b*. Therefore an inventive guide device 9 or its guide device base disk 11 can in one exemplary embodiment similar to that of FIG. 9*a* at least in the region of the cross braces 7*b* have no or no great axial extent. Under circumstances this can result in the advantageous selection of an angle $\alpha<0°$, as stated in the description for FIG. 4.

The further advantageous embodiment in accordance with FIG. 10, which in other respects is similar to that of FIG. 9*a*, 9*b*, is to be seen in the latter context. In order to have the guide device outlet area 36 of the guide device 9 large in spite of the described axial restrictions, which is advantageous for air-flow rate, efficiency and acoustics, the axial extent of the guide device base disk 11 varies viewed over its circumference. In the regions in which the restriction comes into play (namely in the region of the cross braces 7*b*) its axial extent is low. On the other hand, in the other regions its axial extent is greater. As a result the inventive device base disk 11 in the exemplary embodiment is no longer a sectioned solid of rotation, thus sections of the guide device base disk 11 with cylinder jackets coaxial to the axis of rotation of the impeller in far regions of the extent of the guide device base disk 11 are not circles or circular segments, but rather wavy curves, which have variable distances to an imaginary, fixed plane perpendicular to the axis of rotation. For hydraulic reasons it can be further advantageous to adopt the described waviness for the guide device base disk, in section cylinder jackets coaxial to the axis of rotation of the impeller, for the guide device cover plate 12, in order to optimize the hydraulic interaction of the guide device cover plate and base disk 12, 11.

FIGS. 12*a* and 12*b* show a further inventive embodiment of a radial fan with supporting guide device, which can be produced and mounted especially easily and cost-effectively. The required injection molding tools are comparatively simple. FIG. 12*b* shows the same subject matter as FIG. 12*a* in an exploded view. The guide device 9 in the exemplary embodiment is essentially built in 2 parts. The guide device motor connection 21 and nozzle plate connection brace 26 are already integrated in this 2-part guide device. Both parts are plastic injection molded parts. The guide device base disk motor support 41 part consists of the elements guide device base disk 11 and guide device motor connection 21. The guide device cover plate blades 42 part consists of the elements guide device cover plate 12, the guide blades 10 and the nozzle plate connection braces 26. One distinctive feature is that the nozzle plate connection braces 26 are identical or similar in their shape, at least in their radial and circumferential position, to the guide blades 10. The assembly of the guide device 9 together with the nozzle plate 6 can be carried out quickly and easily with 4 screws, which are inserted completely through a through hole from nozzle plate 6 to guide device motor connection 21. This design is particularly economical for impeller diameters less than or equal to 250 mm. The somewhat mirror-symmetrical arrangement of the blades 10 and the nozzle plate connection braces 26 with respect to the guide device cover plate 12 is advantageous for the production process in plastic injection molding, since the expected distortion is low. The guide device 9 in the presented exemplary embodiment is to a great extent rectangular shaped. The extent of the guide device cover plate and base disk 12, 11 in the direction of throughflow varies greatly over the circumference. Guide blades 10 are only arranged in regions that are preferably assigned to the corners of the preferably rectangular outer edges 30, 32 of the guide device cover plate or base disk 12, 11 in the projection to a plane perpendicular to the axis of rotation. The injection molding tools for the parts 6, 41 and 42 can be designed comparatively simply, since there are absolutely no undercuts in axial direction. i.e. in the demolding direction of the tools. The extent of the guide blades 10 and the nozzle plate connection braces 26 is consequently advantageously precisely in axial direction. Centering and fixing aids 43 are provided on the nozzle plate 6 as well as the guide device motor connection 21.

Regarding further advantageous embodiments of the inventive diagonal or radial fans as well as of the inventive guide device, to avoid repetitions reference is made to the general part of the description as well as to the attached claims.

Finally, it should be expressly noted that the previously described exemplary embodiments of the inventive teaching only serves the purpose of explanation of the claimed teaching, but that this teaching is not restricted to the exemplary embodiment.

REFERENCE LIST

1 Blade
2 Motor fan wheel
3 Flat material brace
4 Impeller outlet
5 Motor supporting plate
6 Nozzle plate
7 Spinning suspension
7 *a* Axial brace of the spinning suspension
7 *b* Cross brace of the spinning suspension
8 Motor support plate
9 Guide device
10 Guide blade
10 *a* Short guide blade
10 *b* Long guide blade
11 Guide device base disk
12 Guide device cover plate
13 Motor
14 Inlet nozzle
15 Impeller
16 Impeller base disk
17 Impeller cover plate
18 Gap
19 Labyrinth seal
20 Segment
21 Guide device motor connection
22 Joint
23 Motor connection-brace
23 *a* Divided motor connection-brace
24 Sheet metal guide device motor connection
25 Nozzle plate
26 Nozzle plate connection brace
27 Clamping and screwing element
28 Fastening means
29 Inner edge guide device cover plate
30 Outer edge guide device cover plate
31 Inner edge guide device base disk
32 Outer edge guide device base disk
33 Outer edge impeller cover plate
34 Outer edge impeller base disk
35 Guide device Inlet
36 Guide device Outlet
37 Blade rear edge
38 Guide blade front edge
39 Plate part
40 Motor connection flange
41 Guide device base disk motor support
42 Guide device cover plate blades
43 Fixing aid
44 Guide blade rear edge

The invention claimed is:

1. A diagonal or radial fan comprising a rotating motor fan wheel and an upright guide device that in terms of flow is connected downstream of the motor fan wheel, wherein the motor fan wheel comprises a motor and an impeller with blades that is rotary driven by the motor, said blades being arranged between an impeller cover plate and an impeller base disk, wherein the guide device comprises at least one guide device cover plate and one guide device base disk, wherein the guide device cover plate and the guide device base disk are in continuous elongation to the impeller cover plate and the impeller base disk, and wherein edges of the guide device cover plate and/or the guide device base disk assigned to a guide device outlet in a projection on a plane perpendicular to the axis of rotation are nearly rectangular in design.

2. The diagonal or radial fan according to claim 1, characterized in that there is a gap at the transition of the cover plates and the base disks that is smaller than 2% of the external impeller diameter.

3. The diagonal or radial fan according to claim 1, characterized in that the guide device cover plate and the guide device base disk each runs approximately in continuous elongation to the impeller cover plate and the impeller base disk.

4. The diagonal or radial fan according to claim 1, characterized in that the edges of the guide device cover plate and/or the guide device base disk assigned to the guide device outlet are rectangular in design.

5. The diagonal or radial fan according to claim 1, characterized in that the guide device base disk and/or the guide device cover plate has a section with at least one cylinder jacket coaxial to the axis of rotation of the impeller, having a geometry with a variable position in the axial direction.

6. The diagonal or radial fan according to claim 1, wherein the guide device comprises guide blades arranged between the guide device cover plate and the guide device base disk and is firmly connected to them.

7. The diagonal or radial fan according to claim 6, characterized in that the guide blades in cross-section have a profile similar to that of an airfoil.

8. The diagonal or radial fan according to claim 6, characterized in that the guide blade front edges, sectioned with a plane perpendicular to the axis of rotation of the impeller, lie at least approximately on a circle, and advantageously the minimum distance dS, which each point of a guide blade front edge has to the blade rear edge of the impeller in the course of an impeller revolution, lies in the range of 0.5%-5% of the impeller diameter.

9. The diagonal or radial fan according to claim 6, characterized in that guide blades of different geometries are present and/or the guide blades are unevenly distributed over the circumference of the guide device.

10. The diagonal or radial fan according to claim 1, characterized in that the guide device is built of four segments which are similar or identical.

11. The diagonal or radial fan according to claim 10, characterized in that joints are configured on the edges of the segments to which adjacent segments are joined.

12. The diagonal or radial fan according to claim 11, characterized in that function elements are mounted in the region of the joints, in particular in the region of the guide device base disk for connecting the guide device to the motor or in the region of the guide device cover plate for connecting the guide device to the nozzle plate.

13. The diagonal or radial fan according to claim 1, characterized in that the guide device or a plurality of segments comprising the guide device have as a single piece (monolithic) the elements the guide device cover plate, the guide device base disk, and a plurality of guide blades, or parts of these elements assigned to a segment of the plurality of segments.

14. The diagonal or radial fan according to claim 13, characterized in that a guide device motor connection is completely or segmentally integrated as a single piece (monolithic) in the guide device or the plurality of segments.

15. The diagonal or radial fan according to claim 13, characterized in that nozzle connection plates-braces are completely or segmentally integrated as a single piece (monolithic) in the guide device or the plurality of segments.

16. The diagonal or radial fan according to claim 1, characterized in that the guide device is fastened on a spinning suspension or flat material braces of the diagonal or radial fan.

17. The diagonal or radial fan according to claim 1, characterized in that the guide device consists essentially of two single-piece molded parts, of which one of the two single-piece molded parts has at least the guide device cover plate, a plurality of guide blades and a plurality of nozzle plate connection braces and a second of the two single-piece molded parts has at least the guide device base disk and a guide device motor connection.

18. A system with a diagonal or radial fan or with several diagonal and/or radial fans at a short distance to one another and in parallel arrangement, according to claim 1, wherein the diagonal or radial fan occupies a rectangular shaped installation space.

* * * * *